US005593513A

United States Patent [19]

Ramanan et al.

[11] Patent Number: 5,593,513

[45] Date of Patent: * Jan. 14, 1997

[54] AMORPHOUS FE-B-SI-C ALLOYS HAVING SOFT MAGNETIC CHARACTERISTICS USEFUL IN LOW FREQUENCY APPLICATIONS

[75] Inventors: V. R. V. Ramanan, Cary, N.C.; Gordon E. Fish, Upper Montclair, N.J.; Howard H. Liebermann, Succasunna, N.J.; John Silgailis, Cedar Grove, N.J.

[73] Assignee: AlliedSignal Inc., Morris Township, N.J.

[ * ] Notice: The term of this patent shall not extend beyond the expiration date of Pat. No. 5,593,518.

[21] Appl. No.: 647,152

[22] Filed: May 9, 1996

Related U.S. Application Data

[63] Continuation of Ser. No. 162,691, Dec. 9, 1993, abandoned, which is a continuation-in-part of Ser. No. 996,288, Dec. 23, 1992, abandoned.

[51] Int. Cl.[6] ..... H01F 1/153

[52] U.S. Cl. ..... 148/304; 148/307; 420/117; 420/121

[58] Field of Search ..... 148/304, 403, 148/307; 420/117, 121

[56] References Cited

U.S. PATENT DOCUMENTS

| | | | |
|---|---|---|---|
| Re. 32,925 | 5/1989 | Chen et al. | 148/403 |
| 4,142,571 | 3/1979 | Narasimhan | 164/88 |
| 4,217,135 | 8/1980 | Luborsky et al. | 75/123 |
| 4,219,355 | 8/1980 | DeCristofaro et al. | 75/123 |
| 4,226,619 | 10/1980 | Hatta et al. | 148/120 |
| 4,298,409 | 11/1981 | De Cristofaro et al. | 148/108 |
| 4,300,950 | 11/1981 | Lubrosky et al. | 75/123 |
| 4,437,907 | 3/1984 | Sato et al. | 148/304 |
| 4,865,664 | 9/1989 | Sato et al. | 148/403 |
| 5,035,755 | 7/1991 | Nathasingh et al. | 148/304 |

FOREIGN PATENT DOCUMENTS

| | | | |
|---|---|---|---|
| 0060660 | 9/1982 | European Pat. Off. . | |
| 55-152150 | 11/1980 | Japan | 148/304 |
| 58-34162 | 2/1983 | Japan | 148/304 |
| 58-42751 | 3/1983 | Japan | 148/304 |

OTHER PUBLICATIONS

Fred Luborsky, Joseph Becker, John Walter and D. Martin, The Fe–B–C– Ternary Amorphous Alloys, 1980 pp. 521–525, IEEE Trans. Mag. May 1980.

V. R. V. Ramanan, Metallic Glasses in Distribution Transformer Applications: An Update, 1991 pp. 119–127 J. Mater. Eng., 13.

*Primary Examiner*—John Sheehan

*Attorney, Agent, or Firm*—Ernest D. Buff

[57] ABSTRACT

A rapidly solidified amorphous metallic alloy is composed of iron, boron, silicon and carbon. The alloy exhibits in combination high saturation induction, high Curie temperature, high crystallization temperature, low core loss and low exciting power at line frequencies and is particularly suited for use in cores of transformers for an electrical power distribution network.

19 Claims, 15 Drawing Sheets

Fe = 80 at.%
Silicon
Boron
Carbon
A
B
C
D
E
1
3
17
5
15
7
13
9
11
11
9
13
7
15
5
0
2
4
6
8
10
12

Fe = 79.5 at.%
Silicon
Boron
A
B
C
D
E
F
1
2
3
4
5.5
3.5
1.5
14
7.5
12
9.5
10
11.5
8
13.5
6
0
2
4
6
8
10
12

Fe = 81 at.%
Silicon
Boron
Carbon
2
17
4
15
6
13
8
11
10
9
12
7
14
5
0
2
4
6
8
10
12
372
364
361
376
364
367
393
366
376
364
401
367
400

Fe = 80 at.%
Silicon
Boron
3
17
5
15
7
13
9
11
11
9
13
7
15
5
0
2
4
6
8
10
12
417
424
379
414
398
398
386
393
395
410
381
402
402
398
400
372
419
391
389
379
410

Fe = 79.5 at.%
Silicon
Boron
Carbon
5.5
3.5
1.5
14
7.5
12
9.5
10
11.5
8
13.5
6
0
2
4
6
8
10
12
388
414
418
407
417
417

Fe = 79 at.%
Silicon
Boron
7
5
3
13
9
11
11
9
13
7
15
5
0
2
4
6
8
10
12
419
405
419
399
410
400
400
410
414
414
402
391

Fe = 77 at.%
Silicon
Boron
Carbon
8
6
4
14
10
12
12
10
14
8
16
6
0
2
4
6
8
10
12
169
170
170
168
168
169
168
167
167
167
167
166
166

AMORPHOUS FE-B-SI-C ALLOYS HAVING SOFT MAGNETIC CHARACTERISTICS USEFUL IN LOW FREQUENCY APPLICATIONS

CROSS REFERENCE TO RELATED APPLICATIONS

This application is a continuation of application Ser. No. 08/162,691 filed Dec. 9, 1993, now abandoned which is a continuation-in-part of U.S. application Ser. No. 996,288, filed Dec. 23, 1992.

BACKGROUND OF THE INVENTION

1. Field of the Invention

This invention relates to amorphous metallic alloys, and more particularly to amorphous alloys consisting essentially of iron, boron, silicon, and carbon which find uses in the production of magnetic cores used in the manufacture of electric distribution and power transformers.

2. Description of the Prior Art

Amorphous metallic alloys (metallic glasses) are metastable materials lacking any long range atomic order. They are characterized by x-ray diffraction patterns 1.5 consisting of diffuse (broad) intensity maxima, quantitatively similar to the diffraction patterns observed for liquids or inorganic oxide glasses. However, upon heating to a sufficiently high temperature, they begin to crystallize with the evolution of the heat of crystallization. Correspondingly, the x-ray diffraction pattern begins to change to that observed from crystalline materials, i.e., sharp intensity maxima begin to evolve in the pattern. The metastable state of these alloys offers significant advantages over the crystalline forms of the same alloys, particularly with respect to the mechanical and magnetic properties of the alloy.

For example, there are commercially available metallic glasses which have only about a third of the total core losses of those of conventional crystalline 3 wt. % Si-Fe grain-oriented steels, in applications as magnetic cores of electrical distribution transformers. (See, for example "Metallic Glasses in Distribution Transformer Applications: An Update", by V. R. V. Ramanan, J. Mater. Eng., 13, (1991) pp. 119–127). Considering that there are about 30 million distribution transformers in the U.S. alone, which consume about 5 billion pounds of magnetic core material, the potential for energy savings and the associated economic benefits resulting from the use of metallic glasses in distribution transformer cores can be substantial.

Amorphous metallic alloys are produced generally by rapidly cooling a melt using any of a variety of techniques conventional in the art. The term "rapid cooling" usually refers to cooling rates of at least about $10^{4\circ}$ C./s; in the case of most Fe-rich alloys, generally higher cooling rates ($10^{5\circ}$ to $10^{6\circ}$ C./s) are necessary to suppress the formation of crystalline phases, and to quench the alloy into the metastable amorphous state. Examples of the techniques available for fabricating amorphous metallic alloys include sputter or spray depositing onto a (usually chilled) substrate, jet casting, planar flow casting, etc. Typically, the particular composition is selected, powders or granules of the requisite elements (or of materials that decompose to form the elements, such as ferroboron, ferrosilicon, etc.) in the desired proportions are then melted and homogenized and the molten alloy is then rapidly quenched at a rate appropriate, for the chosen composition, to the formation of the amorphous state.

The most preferred process for fabricating continuous metallic glass strip is the process known as planar flow casting, set forth in U.S. Pat. No. 4,142,571 to Narasimhan, assigned to Allied-Signal Inc. The planar flow casting process comprises the steps of:

(a) moving the surface of a chill body in a longitudinal direction at a predetermined velocity of from about 100 to about 2000 meters per minute past the orifice of a nozzle defined by a pair of generally parallel lips delimiting a slotted opening located proximate to the surface of the chill body such that the gap between the lips and the surface changes from about 0.03 to about 1 millimeter, the orifice being arranged generally perpendicular to the direction of movement of the chill body, and (b) forcing a stream of molten alloy through the orifice of the nozzle into contact with the surface of the moving chill body to permit the alloy to solidify thereon to form a continuous strip. Preferably, the nozzle slot has a width of from about 0.3 to 1 millimeter, the first lip has a width at least equal to the width of the slot and the second lip has a width of from about 1.5 to 3 times the width of the slot. Metallic strip produced in accordance with the Narasimhan process can have widths ranging from 7 millimeters, or less, to 150 to 200 mm, or more. The planar flow casting process described in U.S. Pat. No. 4,142,571 is capable of producing amorphous metallic strip ranging from less than 0.025 millimeters in thickness to about 0.14 millimeters or more, depending on the composition, melting point, solidification and crystallization characteristics of the alloy employed.

Understanding which alloys can be produced economically and in large quantities in the amorphous form and the properties of alloys in the amorphous form has been the subject of considerable research over the past 20 years. The most well-known disclosure directed to the issue—What alloys can be more easily produced in the amorphous form?—is U.S. Pat. No. Re 32,925 to H. S. Chen and D. E. Polk, assigned to Allied-Signal Inc. Disclosed therein is a class of amorphous metallic alloys having the formula $M_aY_bZ_c$, where M is a metal consisting essentially of a metal selected from the group of iron, nickel, cobalt, chromium, and vanadium, Y is at least one element selected from the group of phosphorus, boron and carbon, Z is at least one element form the group consisting of aluminum, antimony, beryllium, germanium, indium, tin and silicon, "a" ranges from about 60 to 90 atom %, "b" ranges from about 10 to 30 atom % and "c" ranges from about 0.1 to 15 atom percent. Today, the vast majority of commercially available amorphous metallic alloys are within the scope of the above-recited formula.

With continuing research and development in the area of amorphous metallic alloys, it has become apparent that certain alloys and alloy systems possess magnetic and physical properties which enhance their utility in certain applications of worldwide importance, particularly in electrical applications as core materials for distribution and power transformers, generators and electric motors.

Early research and development in the area of amorphous metallic alloys identified a binary alloy, $Fe_{80}B_{20}$, as a candidate alloy for use in the manufacture of magnetic cores employed in transformers, particularly distribution transformers, and generators because the alloy exhibited a high saturation magnetization value (about 178 emu/g). It is known, however, that $Fe_{80}B_{20}$ is difficult to cast into amorphous form. Moreover, it tends to be thermally unstable because of a low crystallization temperature and is difficult to produce in ductile strip form. Further, it has been determined that its core loss and exciting power requirements are only minimally acceptable. Thus, alloys of improved castability and stability, and improved magnetic properties, had to be developed to enable the practical use of amorphous metallic alloys in the manufacture of magnetic cores, especially magnetic cores for distribution transformers.

Subsequent to additional research, ternary alloys of Fe-B-Si were identified as superior to $Fe_{80}B_{20}$ for use in such applications. A wide range of alloy classes, with their own unique set of magnetic properties, have been disclosed over the years. U.S. Pat. Nos. 4,217,135 and 4,300,950 to Luborsky et al. disclose a class of alloys represented generally by the formula $Fe_{80-84}B_{12-19}Si_{1-8}$ subject to the provisos that the alloy must exhibit a saturation magnetization value of at least about 174 emu/g (a value presently recognized as the preferred value) at 30° C., a coercivity less than about 0.03 Oe and a crystallization temperature of at least about 320° C. Freilich et al. in U.S. patent application Ser. No. 220,602, assigned to Allied-Signal Inc., disclosed that a class of Fe-B-Si alloys represented by the formula $Fe_{-75-78.5}B_{-11-21}Si_{4-10.5}$ exhibited high crystallization temperature combined with low core loss and low exciting power requirements at conditions approximating the ordinary transformer operating conditions of magnetic cores in distribution transformers (i.e. 60 Hz, 1.4 T at 100° C.), while maintaining acceptably high saturation magnetization values.

Canadian Patent No. 1,174,081 discloses that a class of alloys defined by the formula $Fe_{77-80}B_{12-16}Si_{5-10}$ exhibit low core loss and low coercivity at room temperature after aging, and have high saturation magnetization values. In U.S. Pat. No. 5,035,755, assigned to Allied-Signal Inc., Nathasingh et al. disclose a class of alloys useful for manufacture of magnetic cores for distribution transformers, which are represented by the formula $Fe_{79.4-79.8}B_{12-14}Si_{6-8}$, and which alloys exhibit unexpectedly low core loss and exciting power requirements both before and after aging, in combination with an acceptably high saturation magnetization value. Finally, U.S. patent application Ser. No. 479,489 to Ramanan et al., assigned to Allied-Signal Inc., disclosed yet another class of Fe-B-Si alloys with high iron contents exhibiting improved utility and handleability in the production of magnetic cores used in the manufacture of electric distribution and power transformers. It is disclosed that these alloys have the combination of high crystallization temperature, high saturation induction, low core loss and low exciting power requirements at 60 Hz and 1.4 T at 25° C. over a range of annealing conditions, and improved retention of ductility subsequent to anneals over a range of annealing conditions.

In other research efforts to redress the deficient characteristics in $Fe_{80}B_{20}$, and to recover some of the saturation magnetization "lost" from the Fe-B system, the ternary Fe-B-C alloys were taught to have great promise. The properties of alloys in this system are summarized in a comprehensive report by Luborsky et al. in "The Fe-B-C Ternary Amorphous Alloys", General Electric Co. Technical Information Series Report No. 79CRD169, August 1979. It is disclosed in this report that while a high saturation magnetization value persists over a wider range of compositions in the Fe-B-C system when compared with the Fe-B-Si system, the beneficial effects found from Si (in Fe-B-Si alloys) on increased crystallization temperatures, and, therefore, alloy stability, were seriously compromised over much of the composition region in the Fe-B-C alloys. In other words, crystallization temperatures usually were reduced when C replaced B. From a magnetic property perspective, a major drawback noted from the Fe-B-C alloys was that the coercivities of these alloys were higher than those of the Fe-B-Si alloys and higher, even, than that of the binary Fe-B alloy. Primarily as a result of these deficiencies in alloy stability and coercivity, the Fe-B-C alloys have not been pursued further, since the time of the Luborsky et al. report, as possible commercially significant alloys for application in magnetic cores of transformers for electrical distribution.

A class of amorphous metallic Fe-B-Si-C alloys represented by the formula $Fe_{80-82}B_{12.5-14.5}Si_{2.5-5.0}C_{1.5-2.5}$ are disclosed by DeCristofaro et al. in U.S. Pat. No. 4,219,355, assigned to Allied-Signal Inc., which alloys are disclosed to exhibit, in combination, high magnetization, low core loss and low volt-ampere demand (at 60 Hz), and wherein the improved ac and dc magnetic characteristics remain stable at temperatures up to 150° C. DeCristofaro et al. also disclose that Fe-B-Si-C alloy compositions outside of the above formula possess unacceptable dc characteristics (coercivity, $B_{80}$ (induction at 1 Oe), etc.), or ac characteristics (core loss and/or exciting power), or both.

Amorphous metallic Fe-B-Si-C alloys are also disclosed in U.S. Pat. No. 4,437,907 to Sato et al. In this patent, it is taught that there is a class of alloys described by the formula $Fe_{74-80}B_{6-13}Si_{8-19}C_{0-3.5}$, which alloys exhibit a low core loss at 50 Hz and 1.26 T and high thermal stability of magnetic properties, and in which alloys, there is, alter aging at 200° C., a high degree of retention of magnetic flux density measured at 1 Oe at room temperature and a good degree of retention of core loss at the above mentioned conditions.

It is readily apparent from the above discussion that researchers focused on different properties as being critical to the determination of which alloys would be best suited for the manufacture of magnetic cores for distribution and power transformers, but none recognized the combination of properties necessary for clearly superior results in all aspects of the production and operation of magnetic cores and, consequently, a variety of different alloys were discovered, each focusing on only part of the total combination. More specifically, conspicuously absent from the above recited disclosures is an appreciation for a class of alloys wherein the alloys exhibit a high crystallization temperature and a high saturation magnetization value, in combination with low core loss and low exciting power requirements alter having been annealed over a wide range of annealing temperatures and times and, in addition, retain sufficient ductility over a range of annealing conditions to ease magnetic core production. Alloys which exhibit this combination of features would find overwhelming acceptance in the transformer manufacturing industry because they would possess the magnetic characteristics essential to improved operation of the transformer and more readily accommodate variations in the equipment, processes and handling techniques employed by different transformer core manufacturers.

The element boron in the amorphous metallic alloys discussed above is the major cost component in the total raw material costs associated with these alloys. For example, in the case of the Fe-B-Si alloys discussed above, 3 percent by weight (about 13 at. %) of boron in an alloy could represent as much as about 70% of the total raw material costs. In addition to the desirable combination of features described above for a transformer core alloy, if such an alloy could have lower boron levels in its composition, thereby allowing reduced total production costs in large scale manufacture of the alloy for transformer applications, a more rapid implementation of amorphous metallic alloy cores would occur, with the attendant societal benefits discussed previously.

SUMMARY OF THE INVENTION

The present invention provides novel metallic alloys composed of iron, boron, silicon, and carbon, which are at least about 70% amorphous, and which consist essentially of the composition $Fe_aB_bSi_cC_d$, where "a"–"d" are in atomic percent, the sum of "a", "b", "c", and "d" equals 100, "a" ranges from about 77 to about 81, "b" is less than about 12, "c" is greater than about 3, and "d" is greater than about 0.5, the compositions being such that: in the ternary cross-section of the quaternary Fe-B-Si-C composition space at "a"=81, "b", "c" and "d" are in the region A, B, C, D, E, A, illustrated in FIG. 1(*a*); in the ternary cross-section of the quaternary Fe-B-Si-C composition space at "a"=80.5, "b", "c" and "d" are in the region A, B, C, D, E, F, A, illustrated in FIG. 1(*b*); in the ternary cross-section of the quaternary Fe-B-Si-C composition space at "a"=80, "b", "c" and "d" are in the region A, B, C, D, E, A, illustrated in FIG. 1(*c*); in the ternary cross-section of the quaternary Fe-B-Si-C composition space at "a"=79.5, "b", "c" and "d" are in the region A, B, C, D, E, F, A, illustrated in FIG. 1(*d*); in the ternary cross-section of the quaternary Fe-B-Si-C composition space at "a"=79, "b", "c" and "d" are in the region A, B, C, D, E, F, A, illustrated in FIG. 1(*e*); in the ternary cross-section of the quaternary Fe-B-Si-C composition space at "a"=78.5, "b", "c" and "d" are in the region A, B, C, D, E, F, A, illustrated in FIG. 1(*f*); in the ternary cross-section of the quaternary Fe-B-Si-C composition space at "a"=78, "b", "c" and "d" are in the region A, B, C, D, E, A, illustrated in FIG. 1(*g*); in the ternary cross-section of the quaternary Fe-B-Si-C composition space at "a"=77.5, "b", "c" and "d" are in the region A, B, C, D, E, A, illustrated in FIG. 1(*h*); and, in the ternary cross-section of the quaternary Fe-B-Si-C composition space at "a"=77, "b", "c" and "d" are in the region A, B, C, D, A, illustrated in FIG. 1(*i*). The alloys of this invention evidence, in combination, a crystallization temperature of at least about 5° C., a Curie temperature of at least about 360° C., a saturation magnetization corresponding to a magnetic moment of at least about 165 emu/g and, a core loss not greater than about 0.35 W/kg and an exciting power value not greater than about 1 VA/kg, when measured at 25° C., 60 Hz and 1.4 T, after the alloys have been annealed at a temperature within the range of 335° C.–390° C., for a time ranging between 0.5 and 4 hours, in the presence of a magnetic field in the range of 5–30 Oe.

The present invention also provides an improved magnetic core comprised of the amorphous metallic alloys of the invention. The improved magnetic core comprises a body (e.g., wound, wound and cut, or stacked) consisting essentially of amorphous metallic alloy ribbon, as described hereinabove, said body having been annealed in the presence of a magnetic field.

The amorphous metallic alloys of the invention have a high saturation induction, a high Curie temperature and a high crystallization temperature in combination with a low core loss and a low exciting power at line frequencies, obtained over a range of annealing conditions, as compared to the prior art alloys. Such a combination makes the alloys of the invention particularly suited for use in cores of transformers for an electrical power distribution network. Other uses may be found in special magnetic amplifiers, relay cores, ground fault interrupters, and the like.

BRIEF DESCRIPTION OF THE DRAWINGS

The invention will be more fully understood, and further advantages will become apparent, when reference is made to the following detailed description of the preferred embodiments of the invention and the accompanying drawings in which.

DESCRIPTION OF THE PREFERRED EMBODIMENTS

Figure 1A:
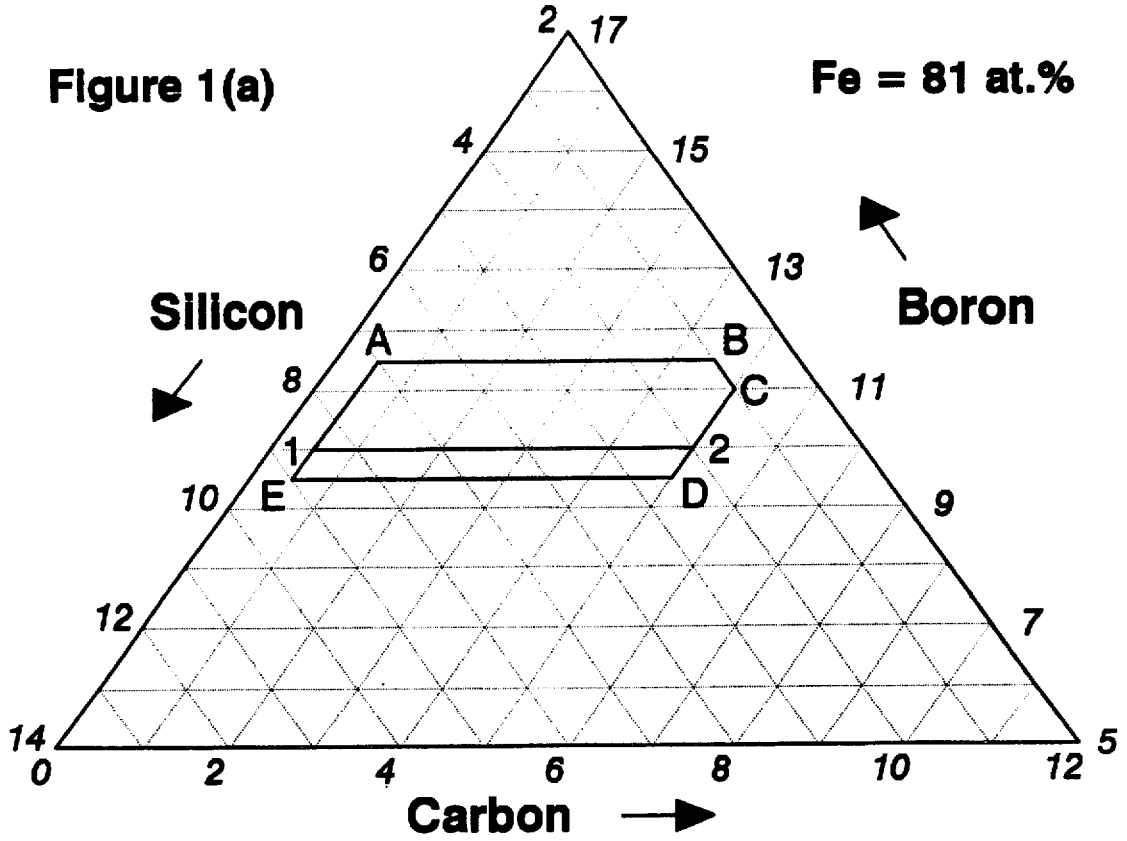
FIGS. 1(*a*), 1(*b*), 1(*c*), 1(*d*), 1(*e*), 1(*f*), 1(*g*), 1(*h*) and 1(*i*) are ternary cross-sections of the quaternary Fe-B-Si-C composition space at various values of iron, as noted, illustrating the basic and preferred alloys of this invention.
Figure 1B:
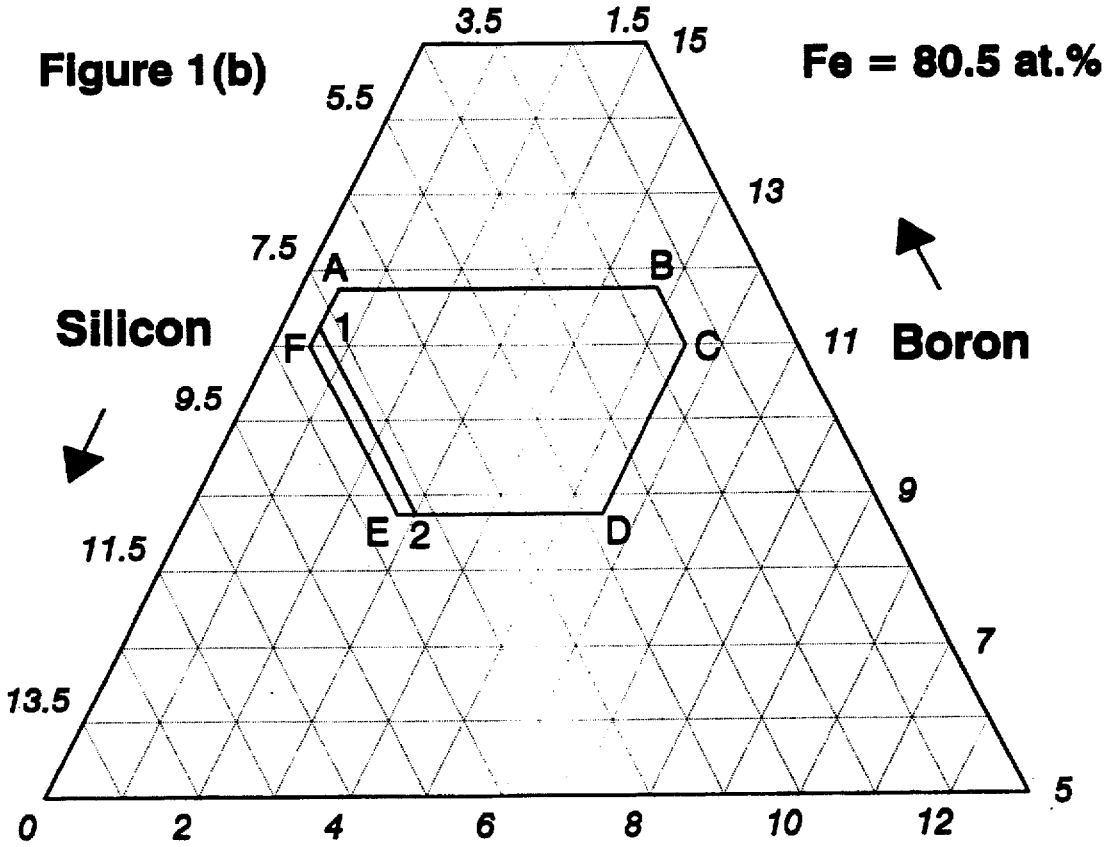
Figure 1C:
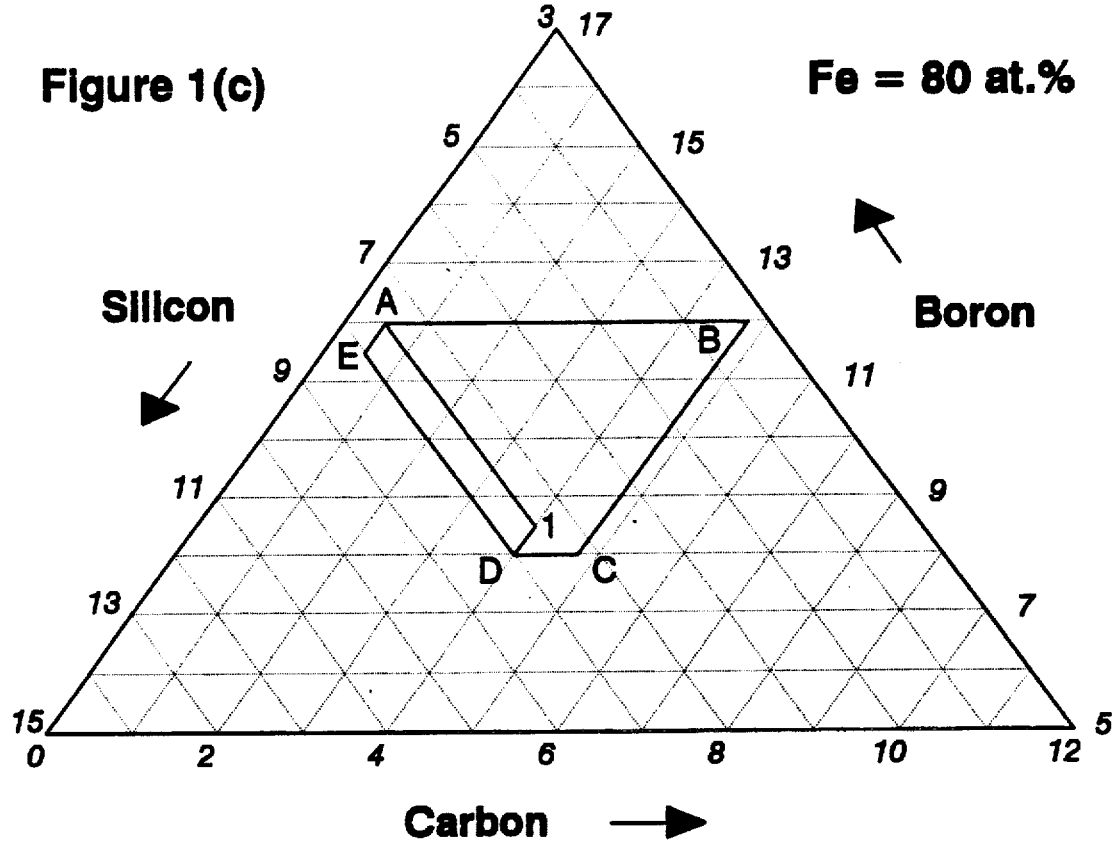
Figure 1D:
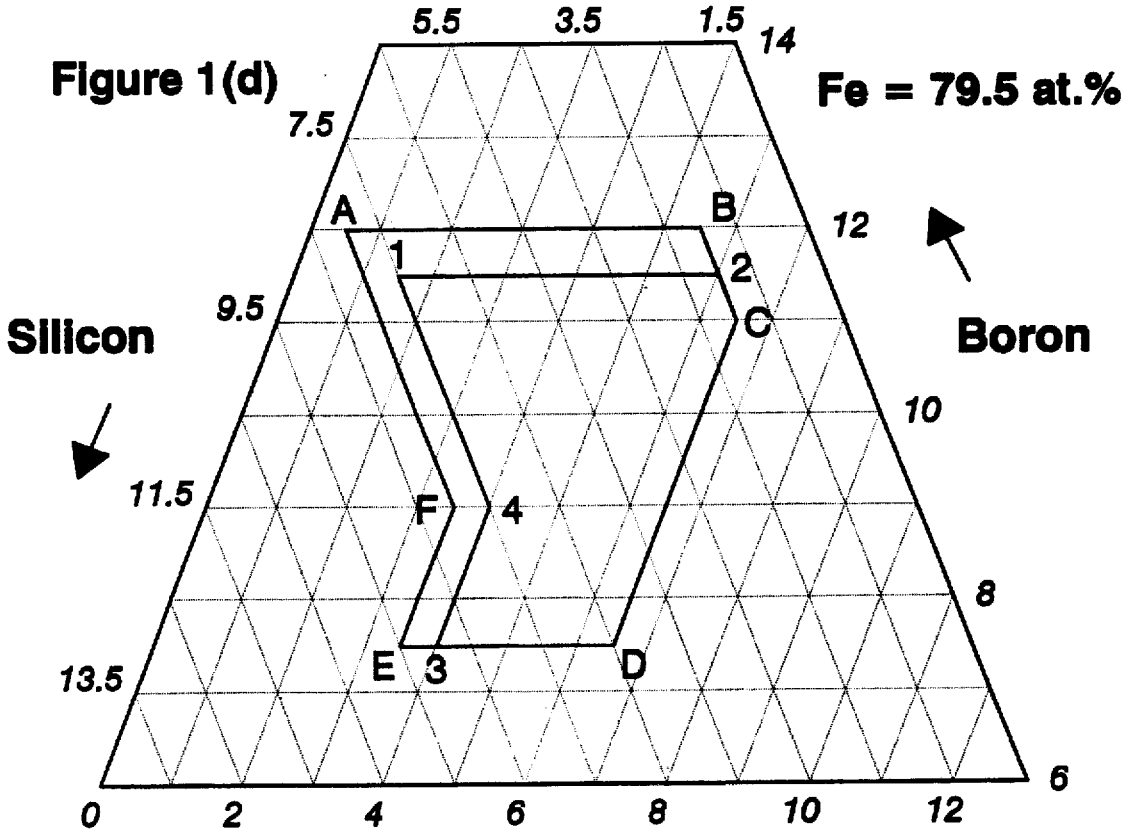
Figure 1E:
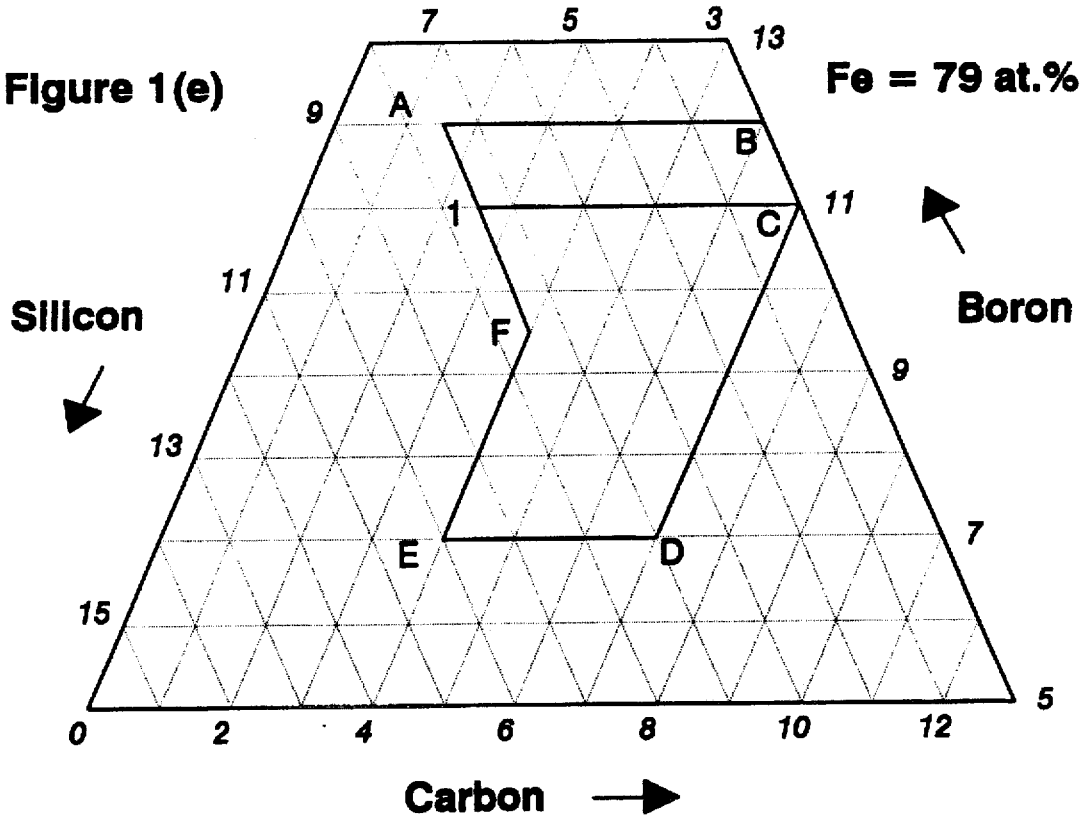
Figure 1F:
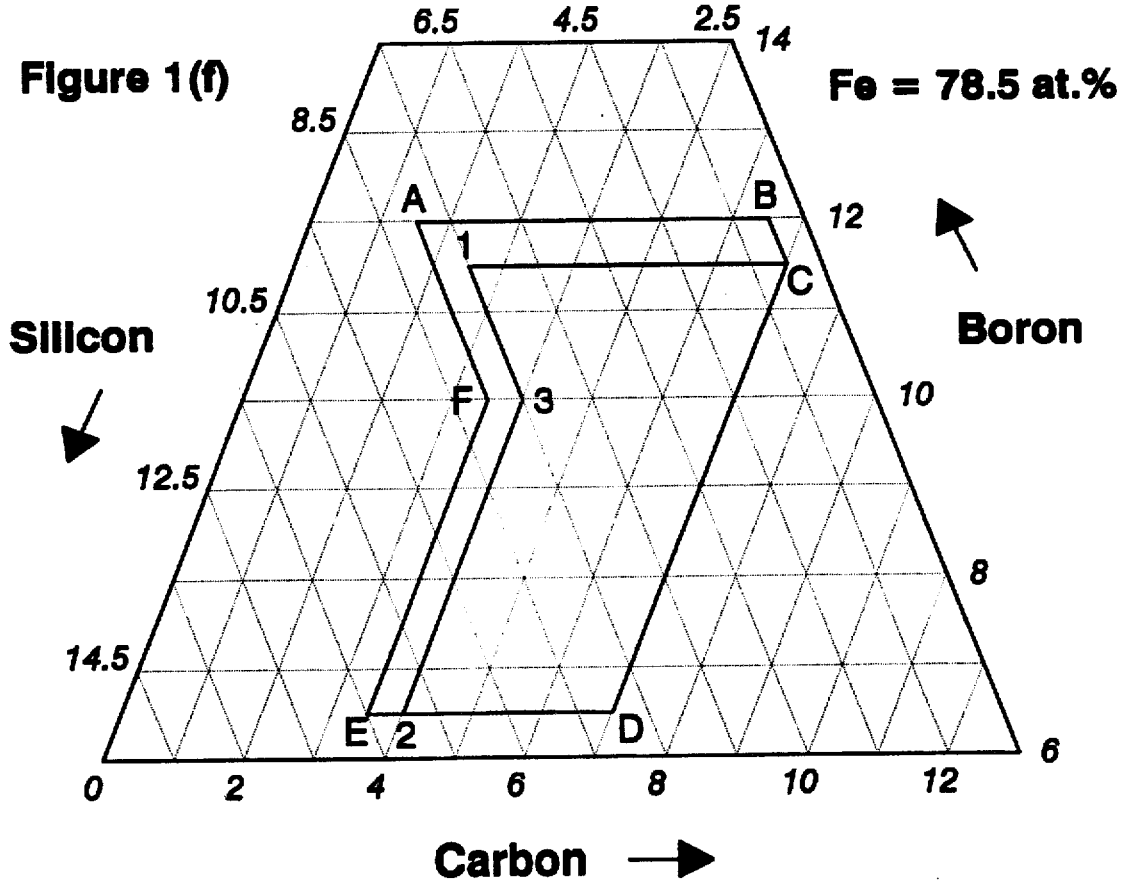
Figure 1G:
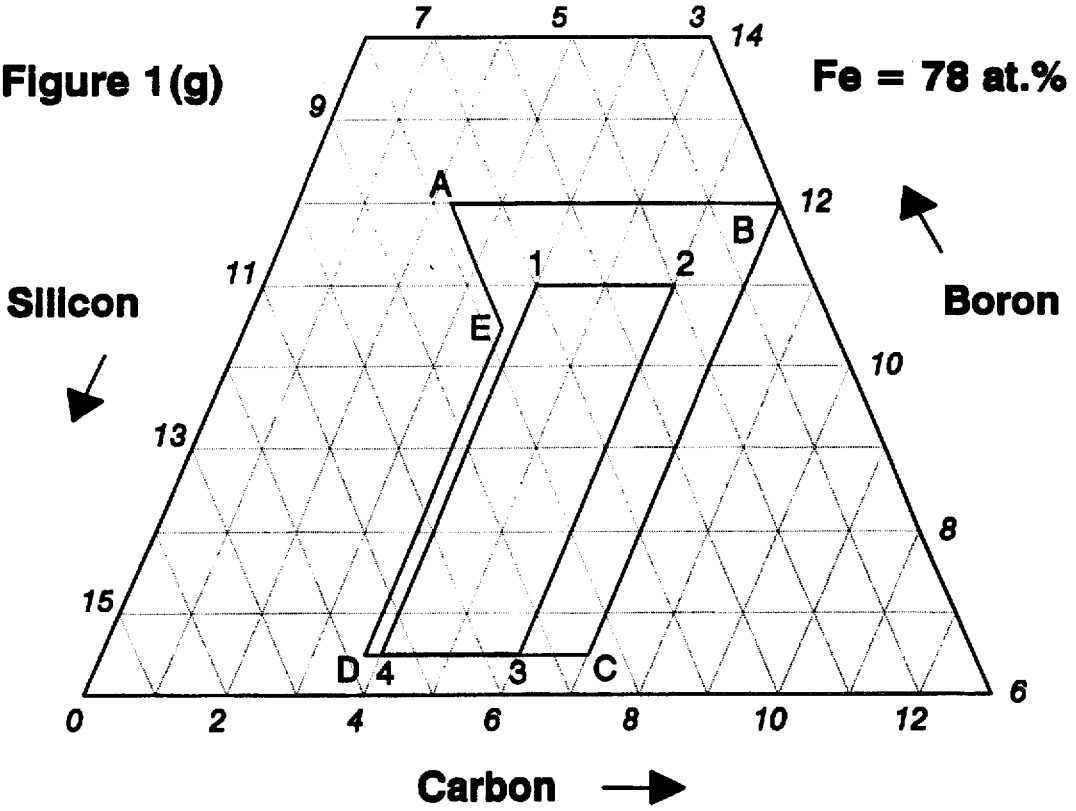
Figure 1H:
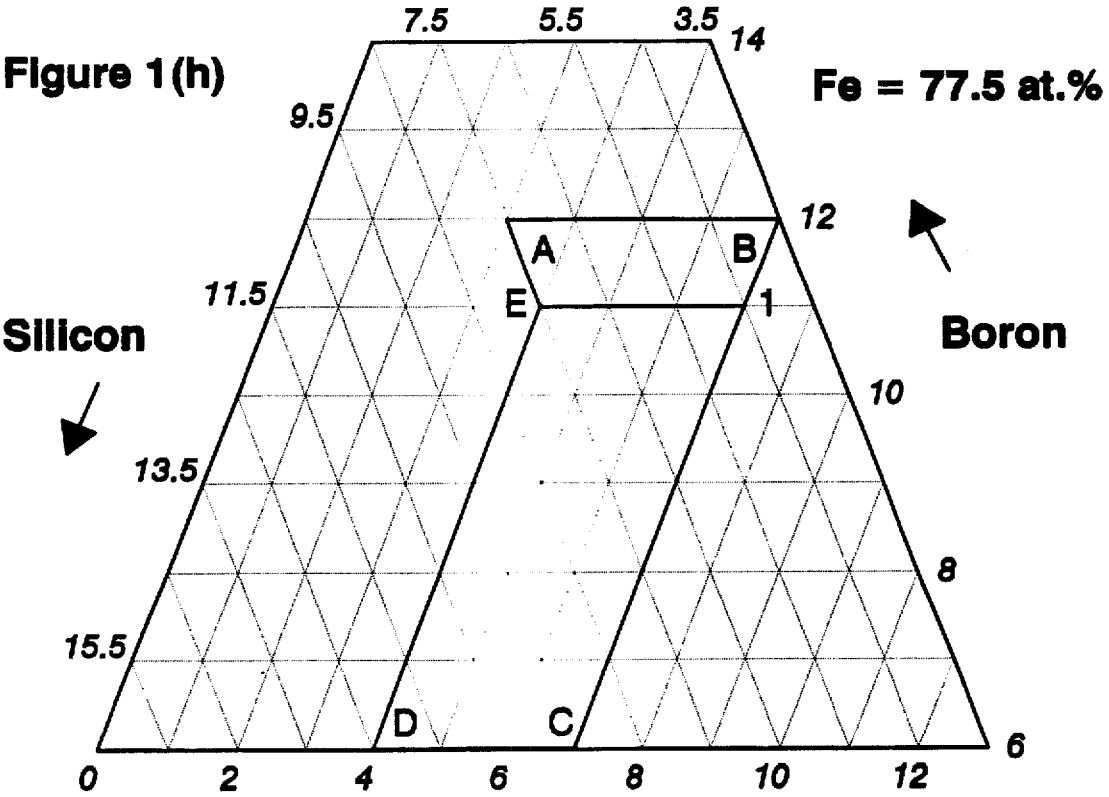
Figure 1I:
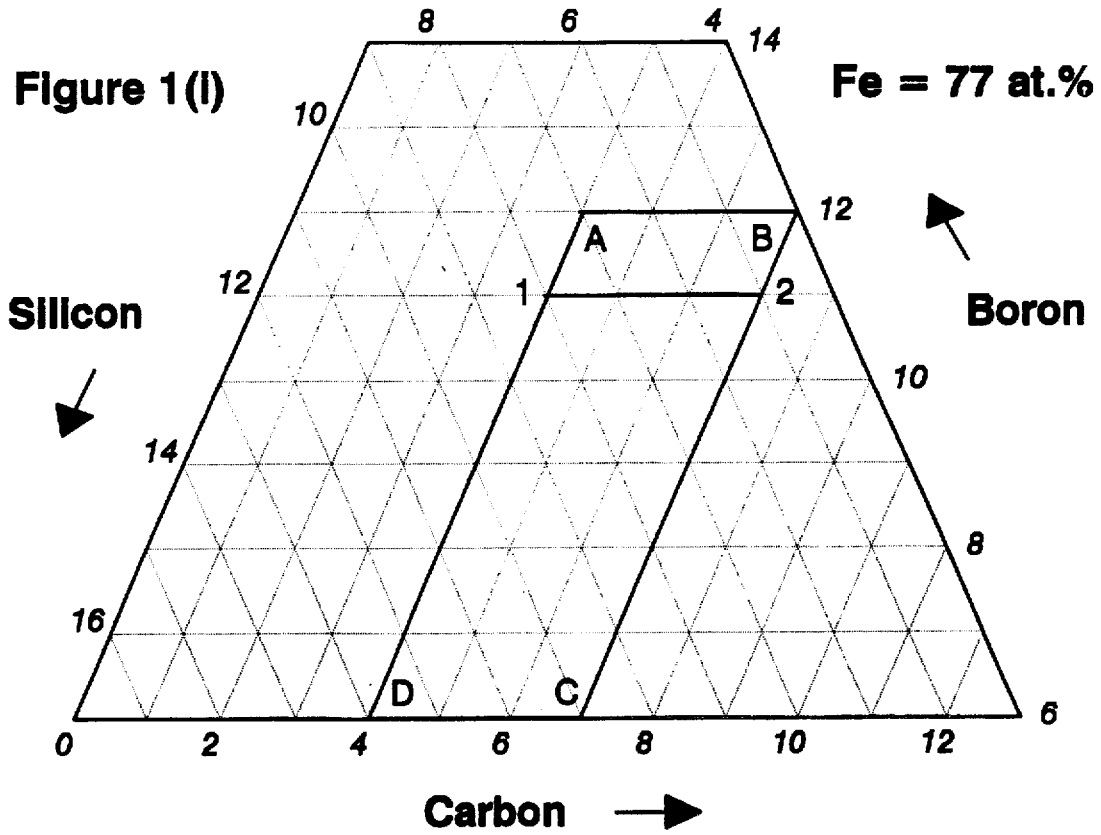
Figure 2A:
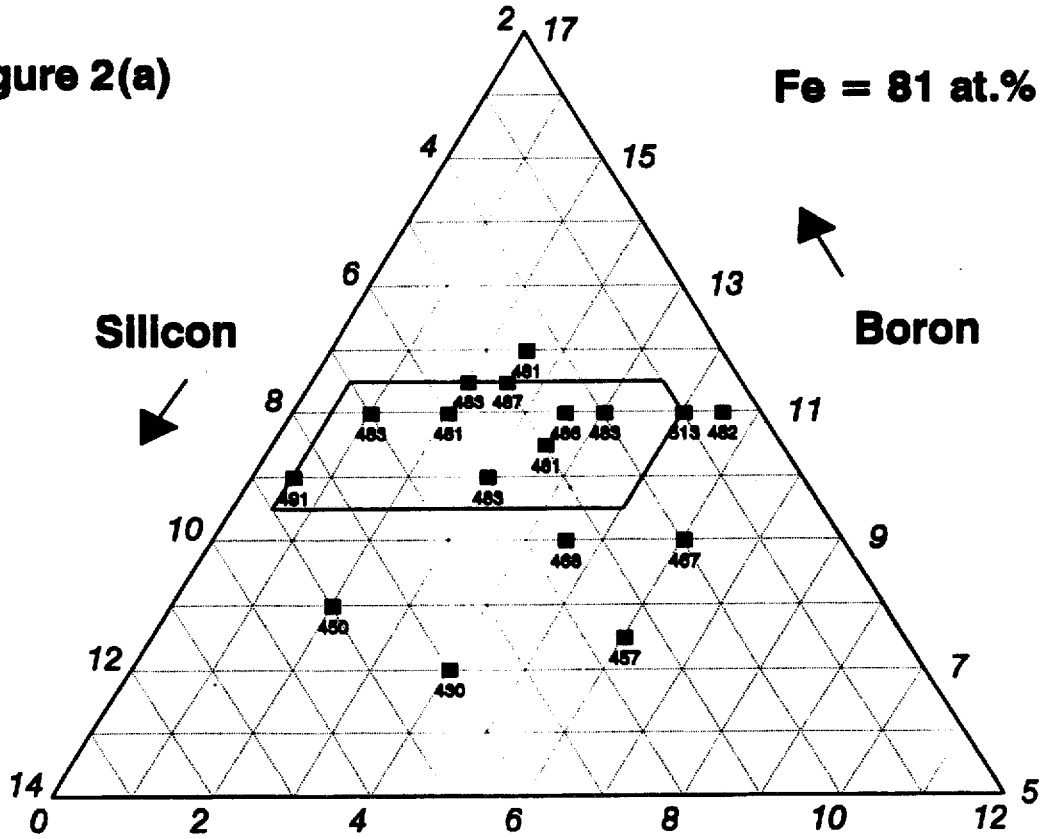
FIGS. 2(*a*), 2(*b*), 2(*c*), 2(*d*), 2(*e*), 2(*f*) and 2(*g*) are ternary cross-sections of the quaternary Fe-B-Si-C composition space at various values of iron, as noted, providing the values for the crystallization temperatures, in °C., of the respective alloy compositions, which are as plotted, and wherein the corresponding ranges of the basic alloys of this invention are also shown.
Figure 2B:
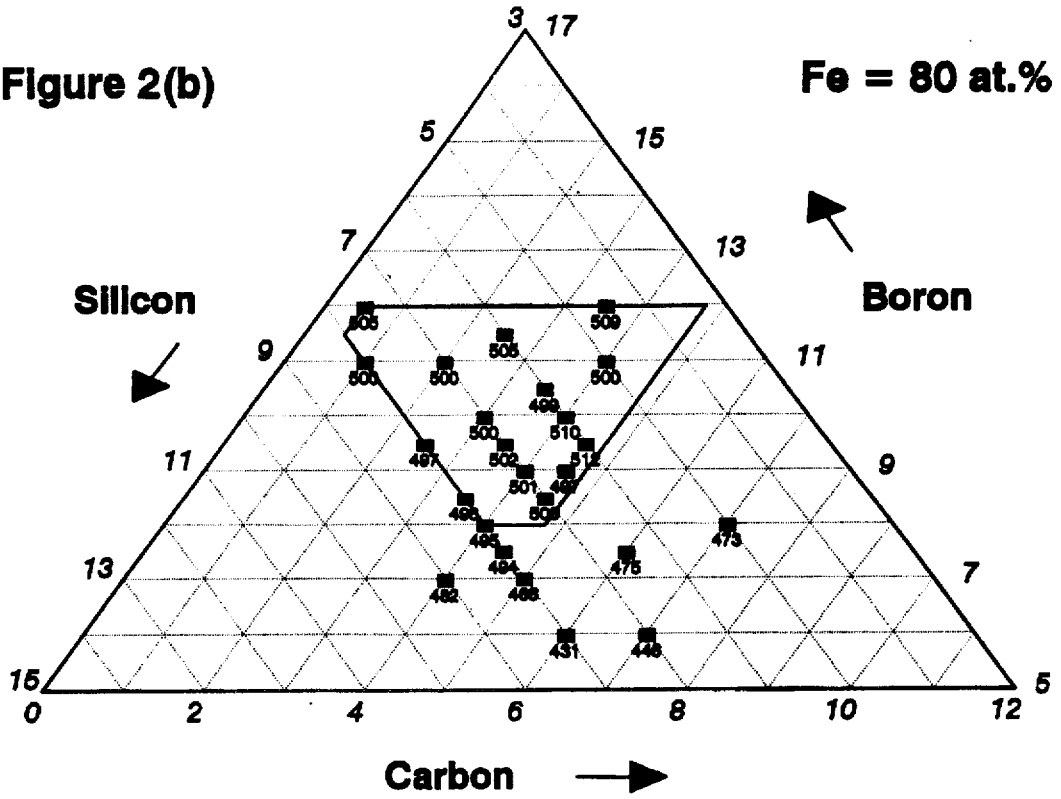
Figure 2C:
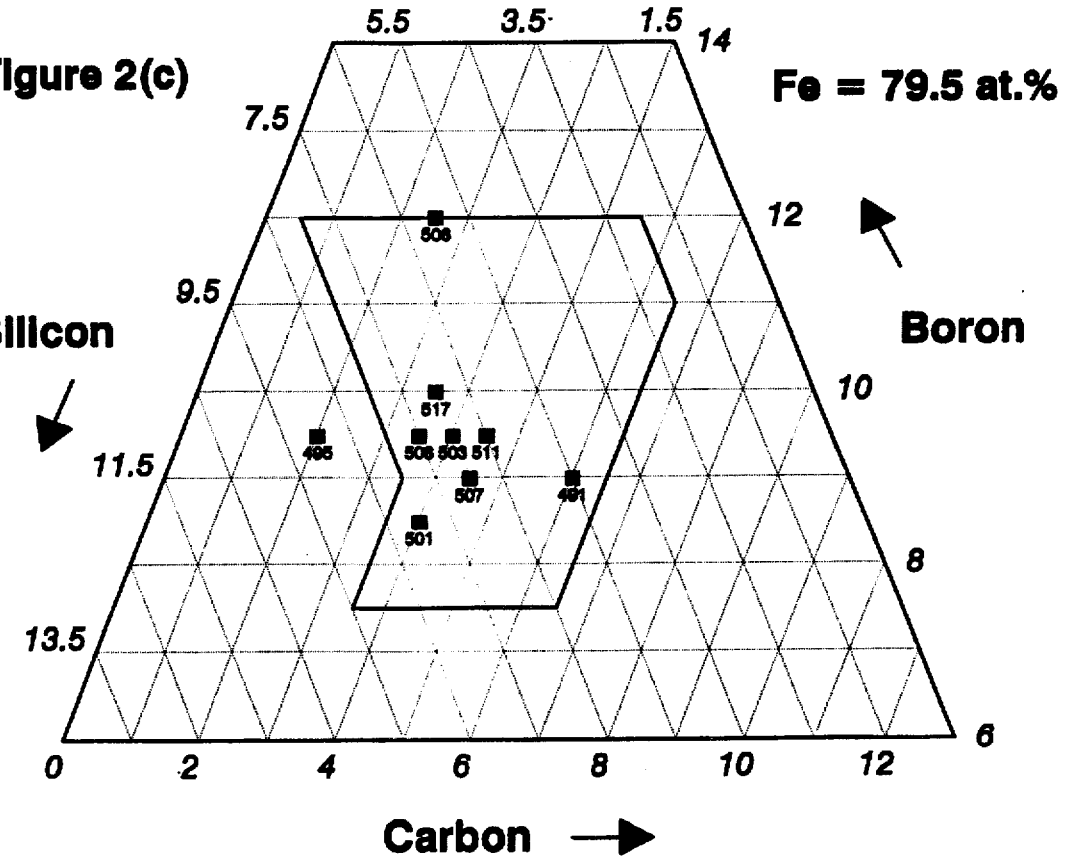
Figure 2D:
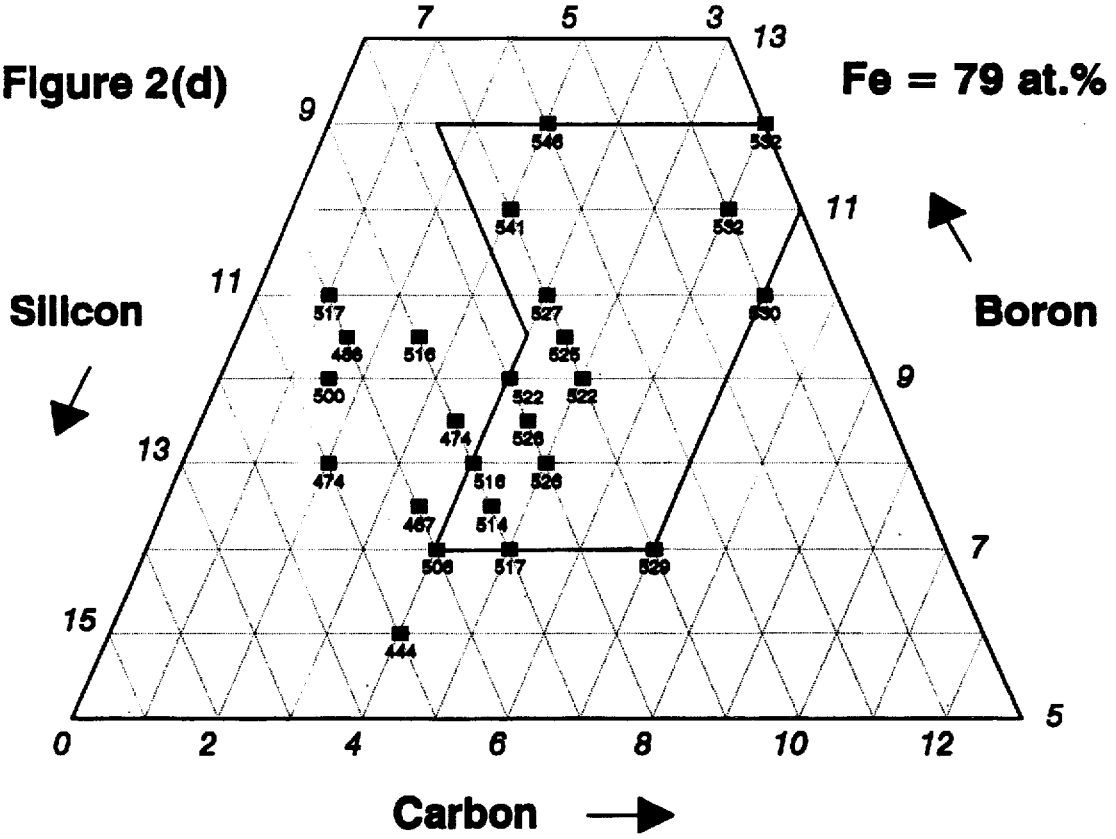
Figure 2E:
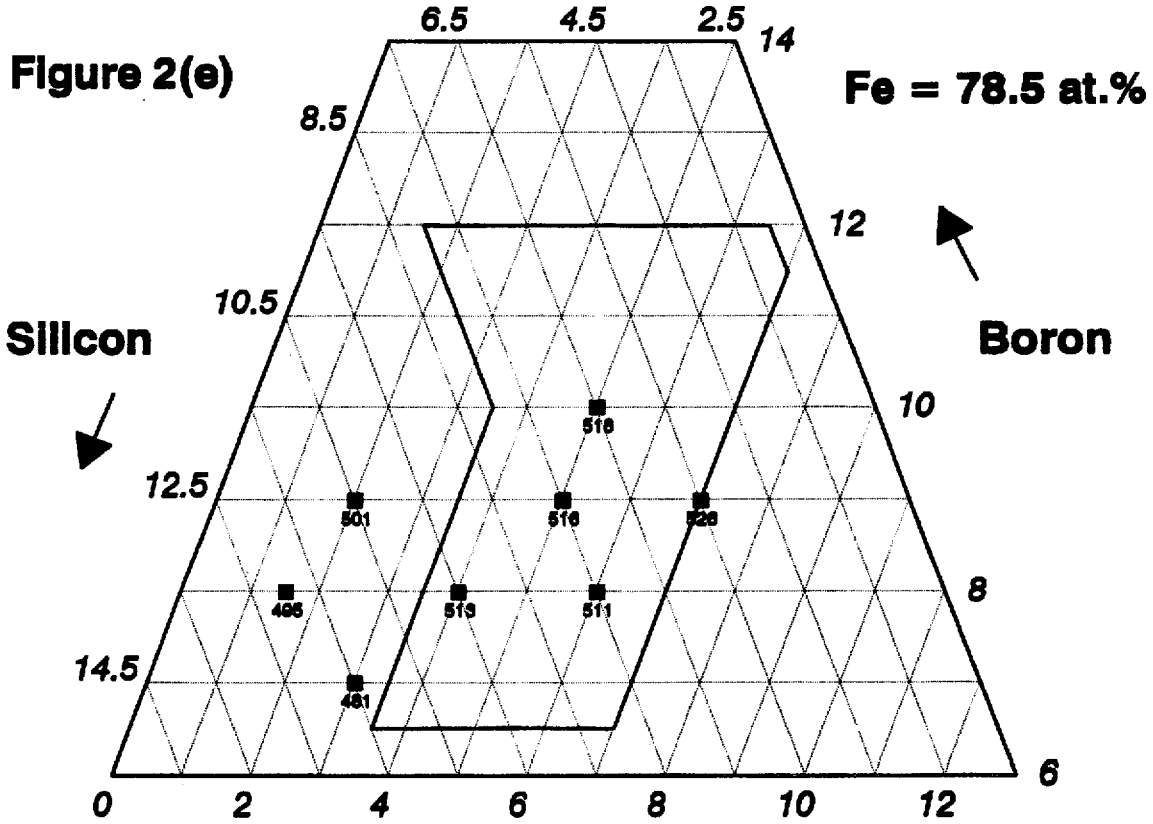
Figure 2F:
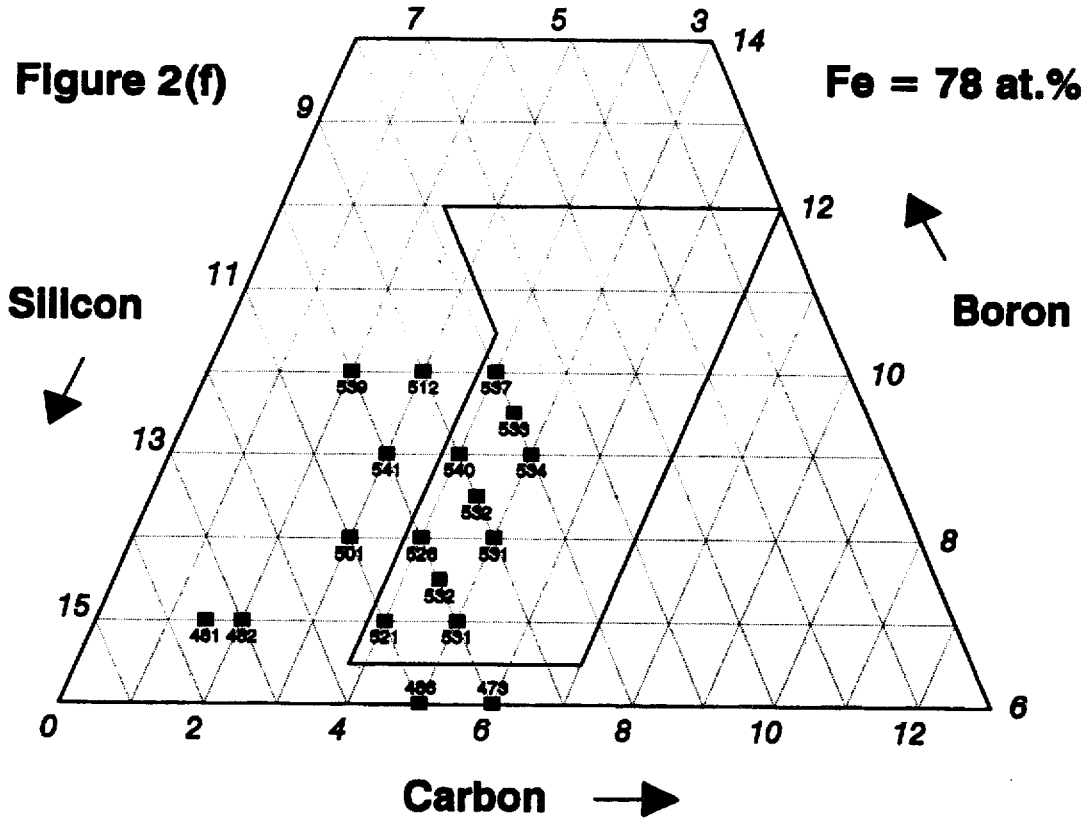
Figure 2G:
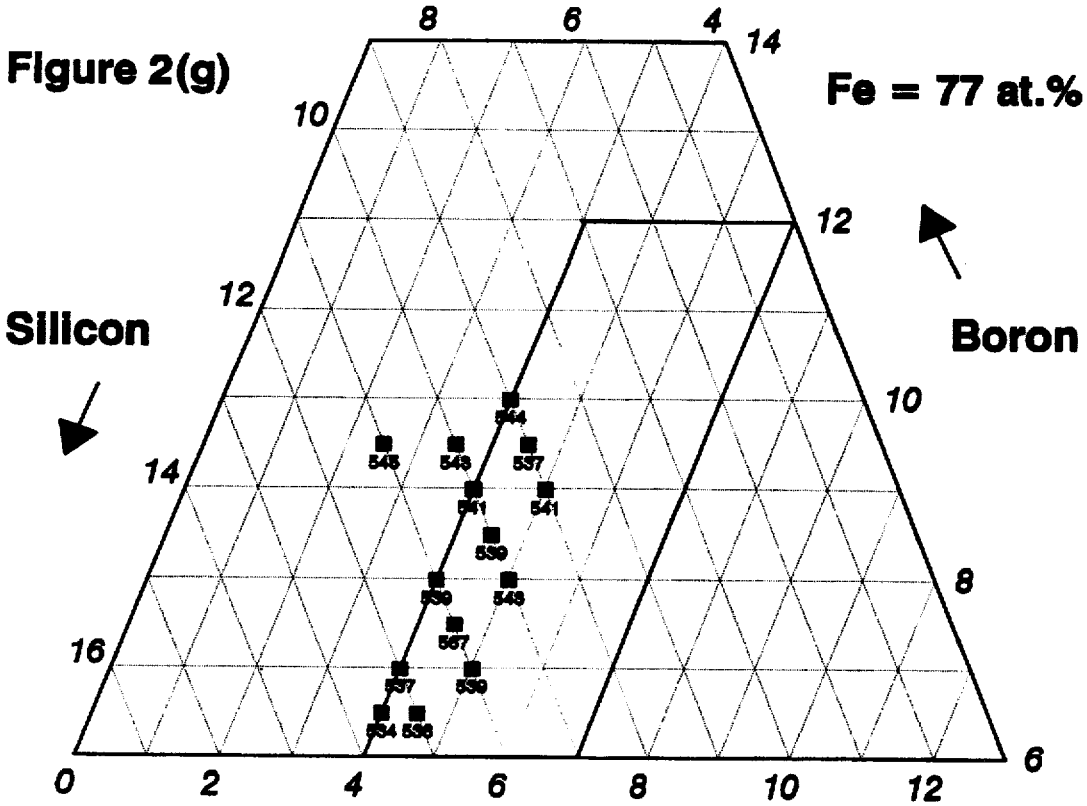
Figure 3A:
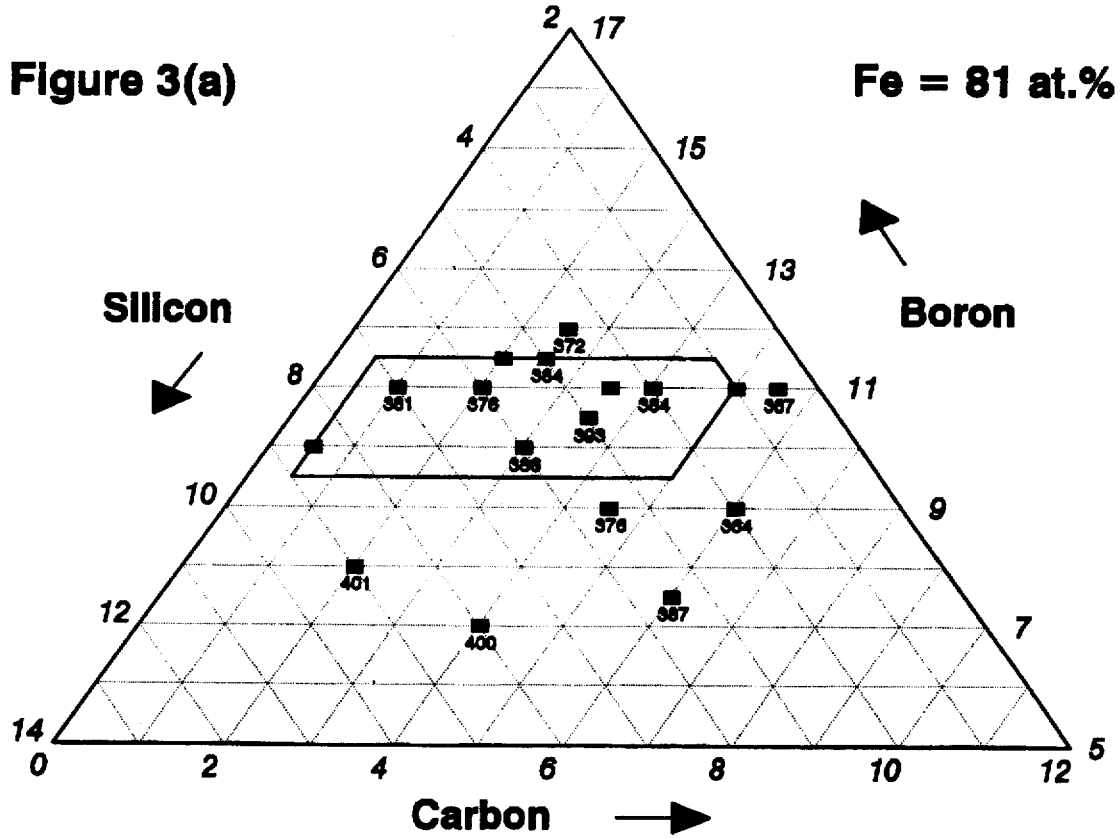
FIGS. 3(*a*), 3(*b*), 3(*c*), 3(*d*), 3(*e*), 3(*f*) and 3(*g*) are ternary cross-sections of the quaternary Fe-B-Si-C composition space at various values of iron, as noted, providing the values for the Curie temperatures, in °C., of the respective alloy compositions, which are as plotted, and wherein the corresponding ranges of the basic alloys of this invention are also shown.
Figure 3B:
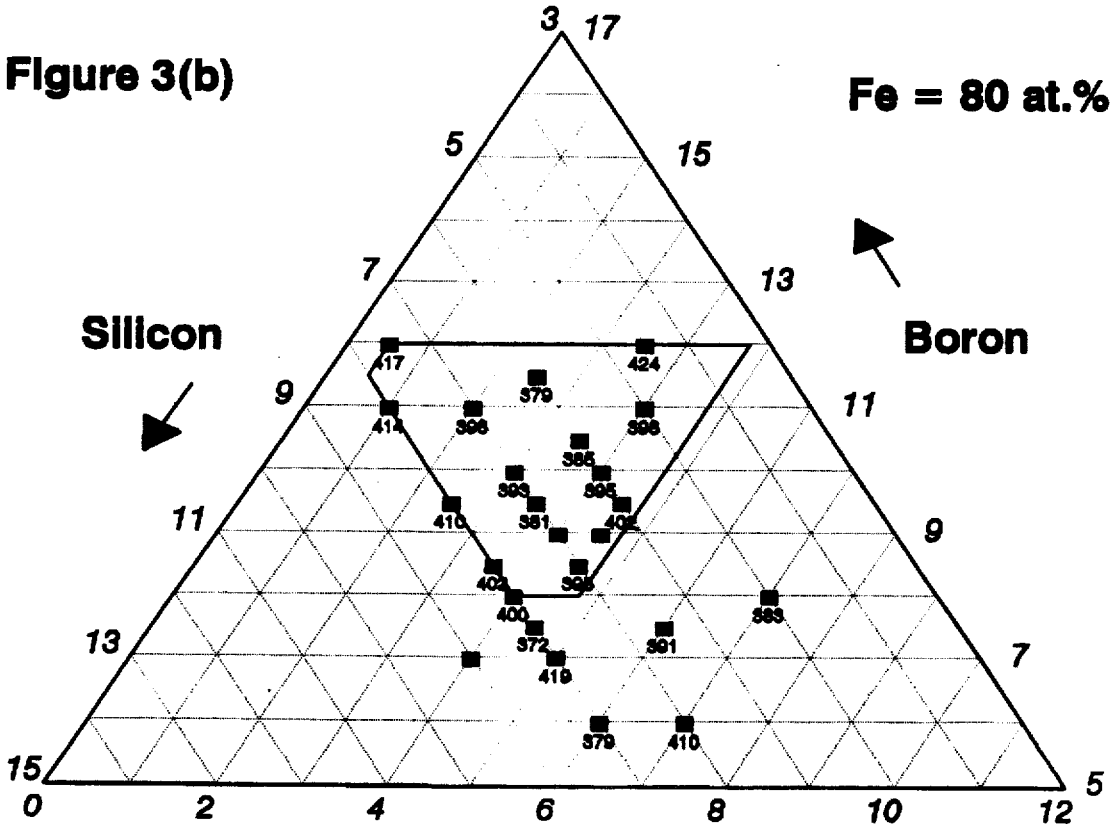
Figure 3C:
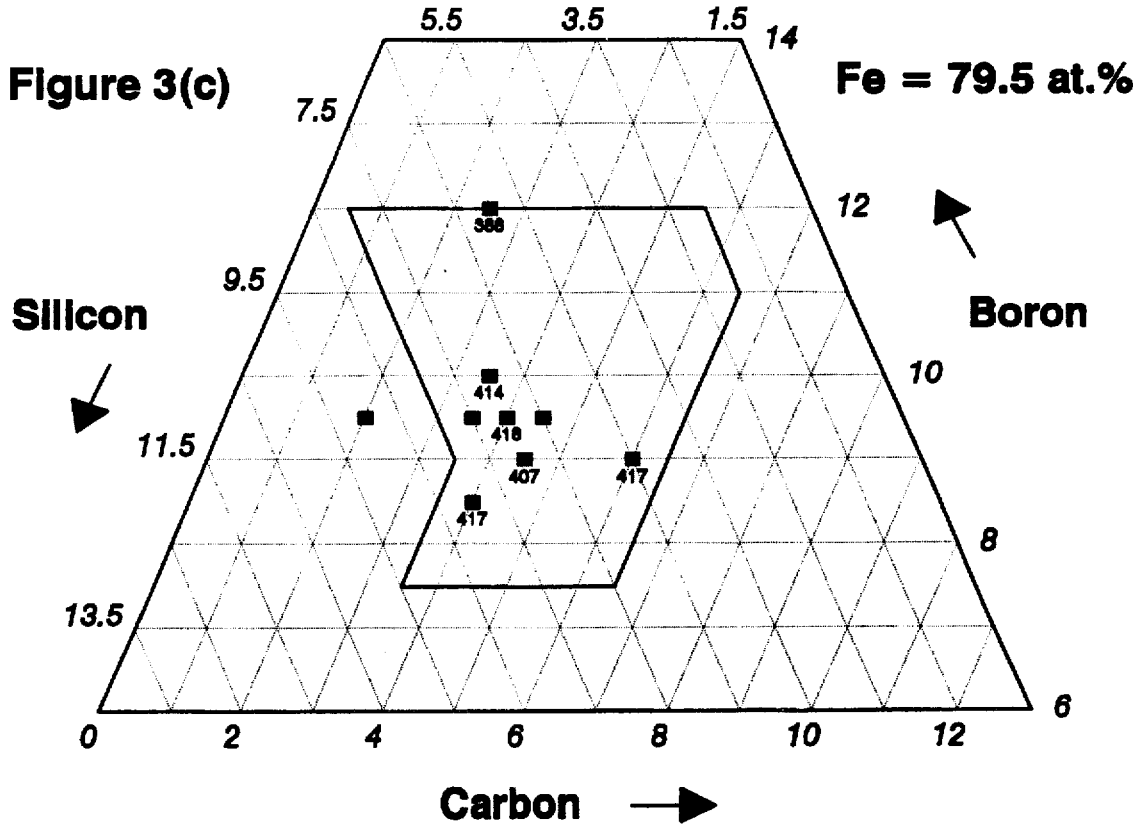
Figure 3D:
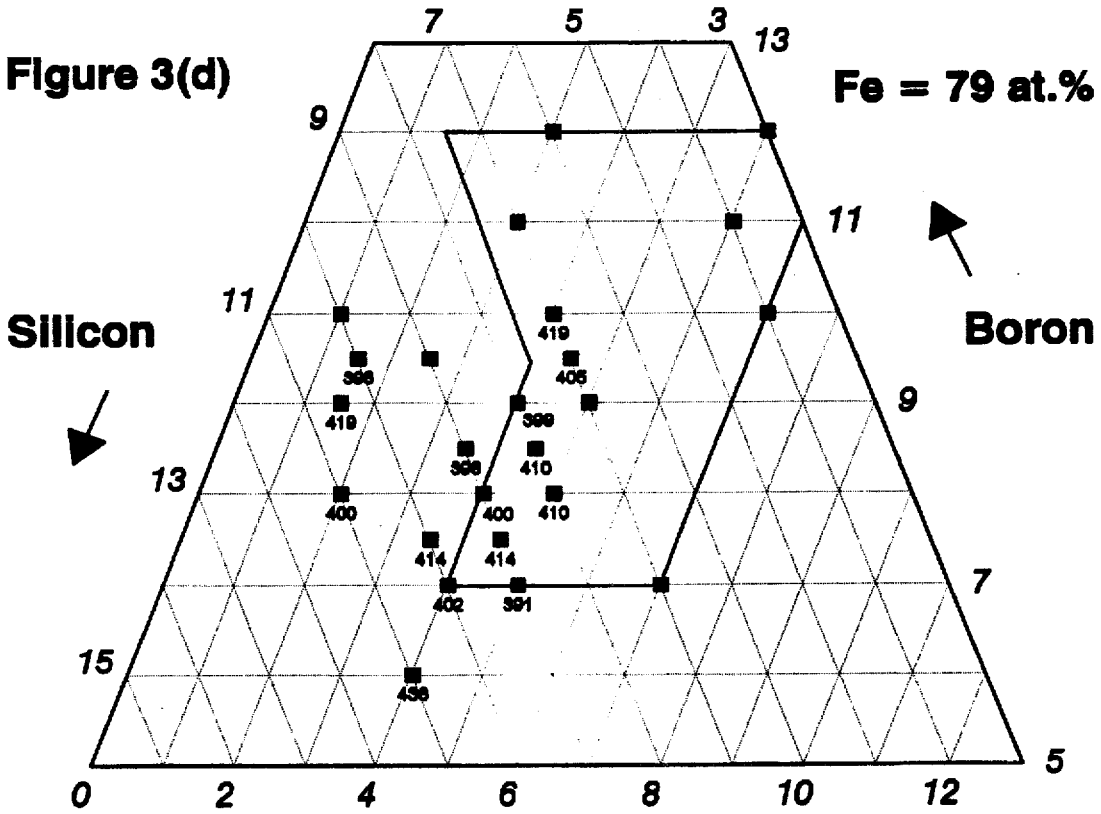
Figure 3E:
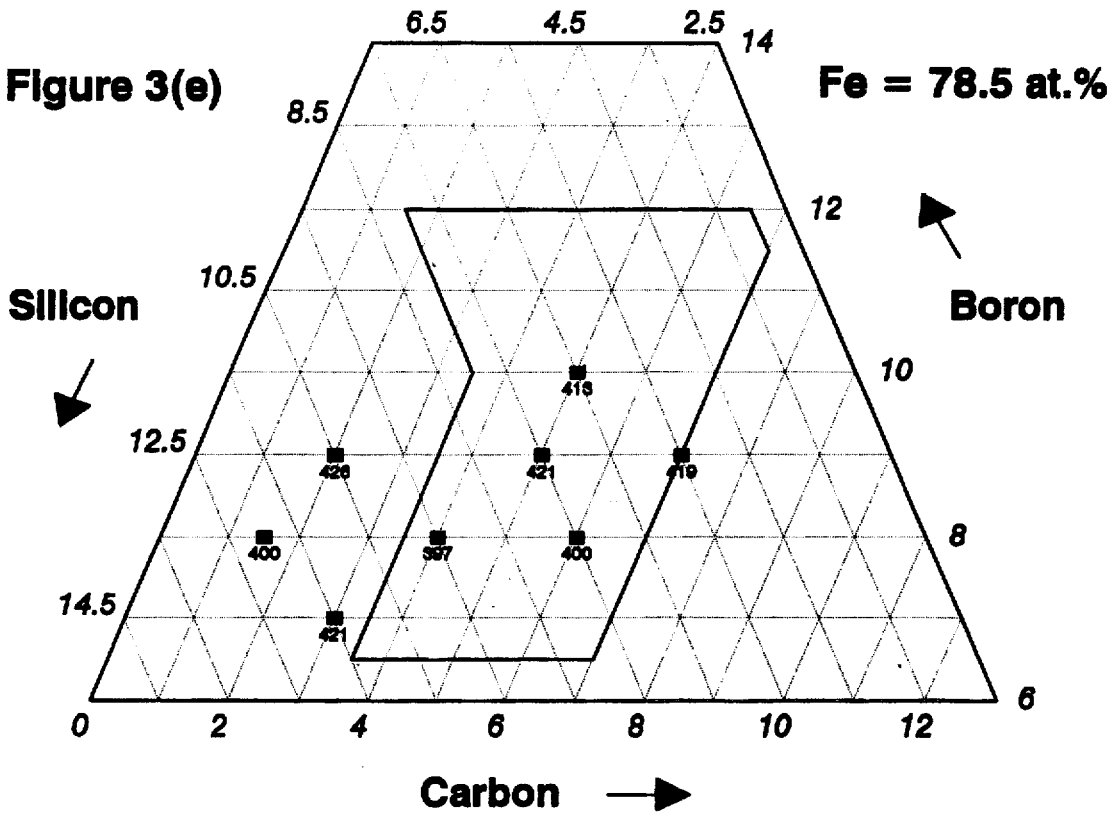
Figure 3F:
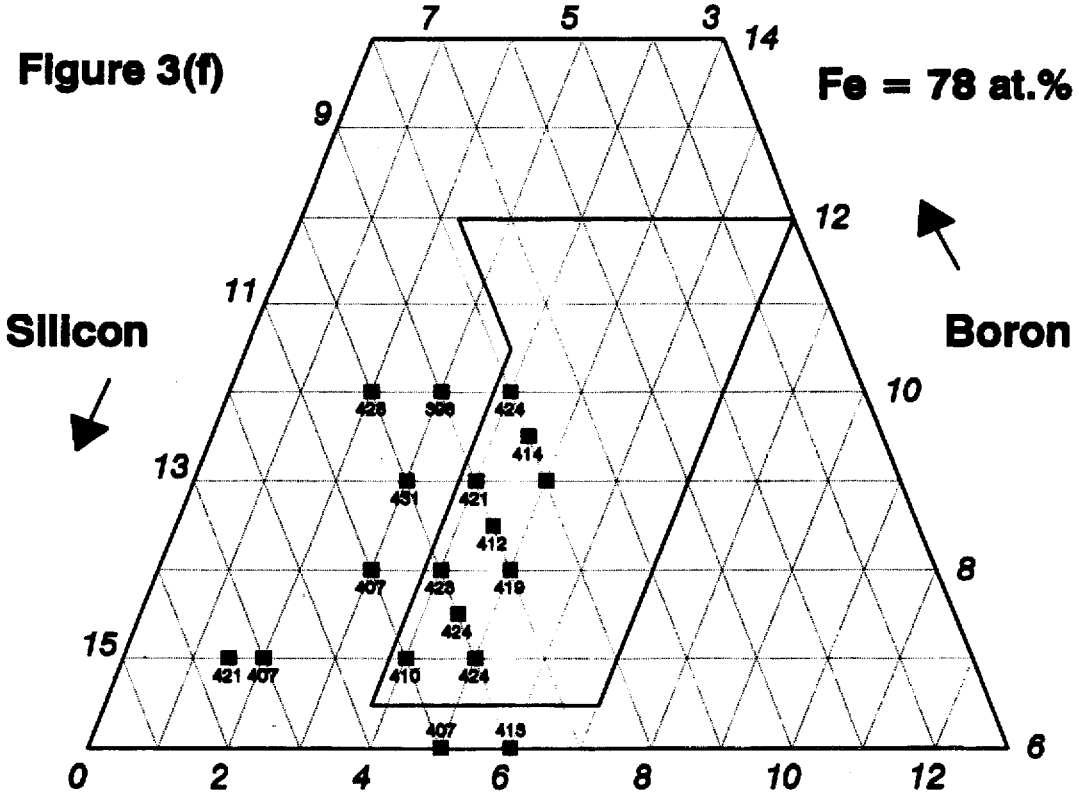
Figure 3G:
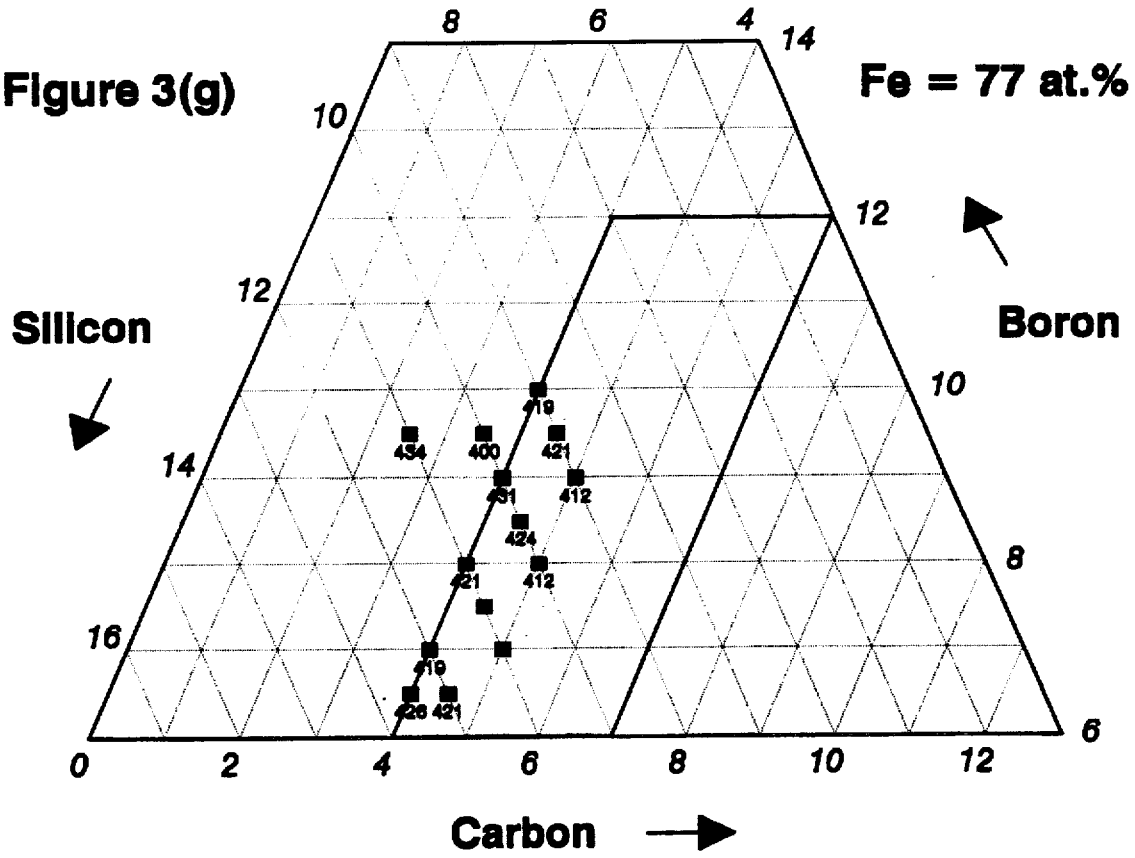
Figure 4A:
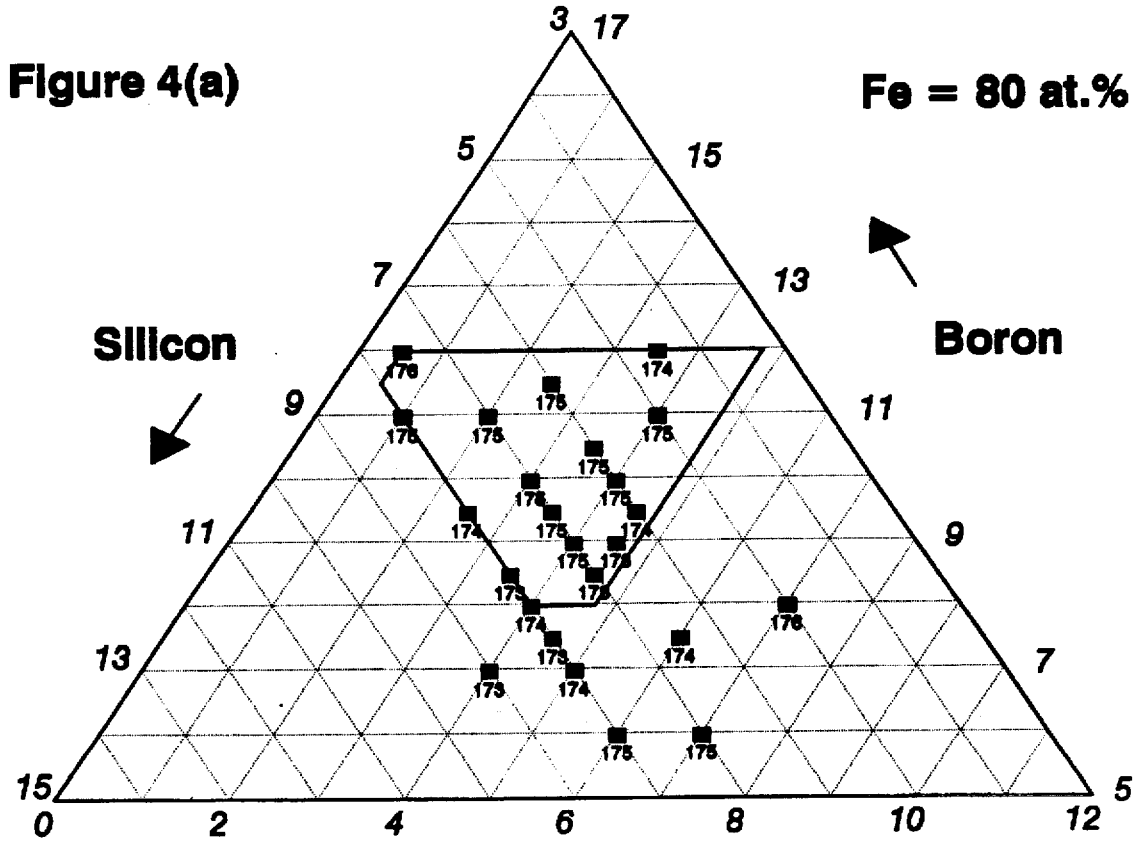
FIGS. 4(*a*), 4(*b*), 4(*c*) and 4(*d*) are ternary cross-sections of the quaternary Fe-B-Si-C composition space at various values of iron, as noted, providing the values for the saturation magnetic moment, in emu/g, of the respective alloy compositions, which are as plotted, and wherein the corresponding ranges of the basic alloys of this invention are also shown.
Figure 4B:
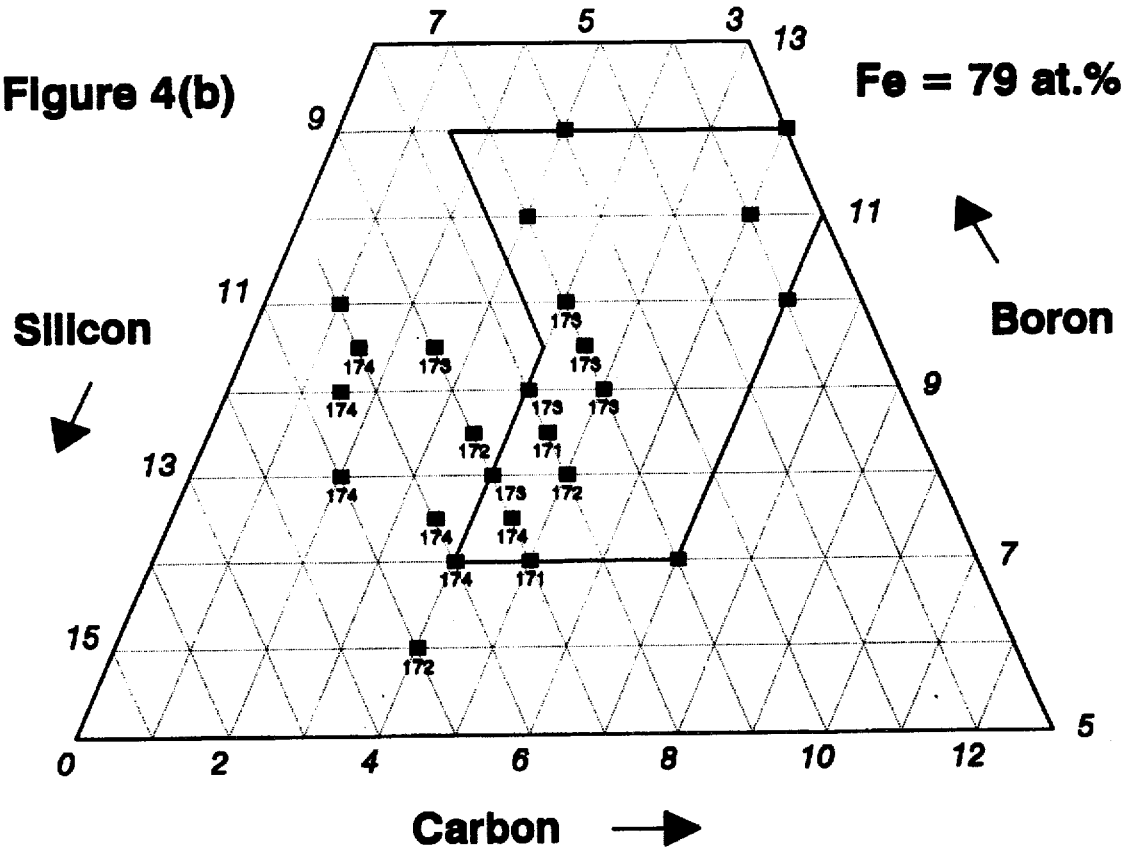
Figure 4C:
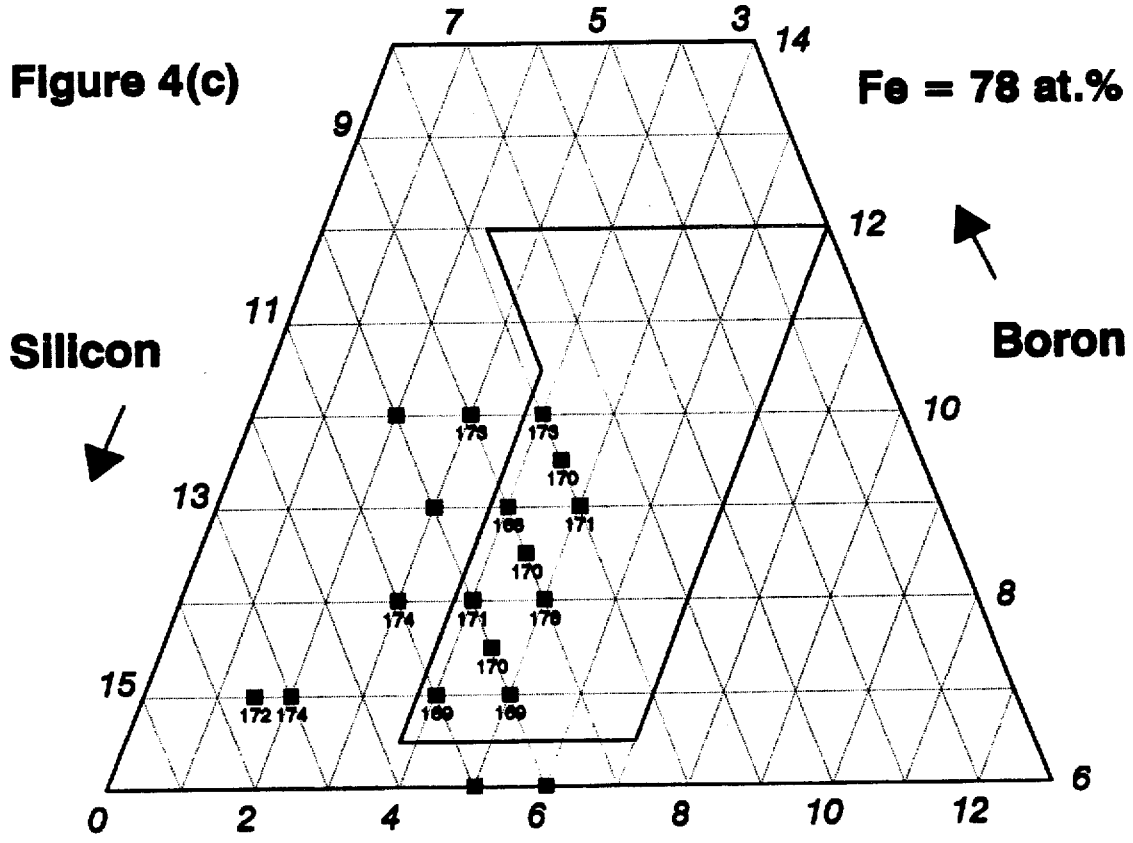
Figure 4D:
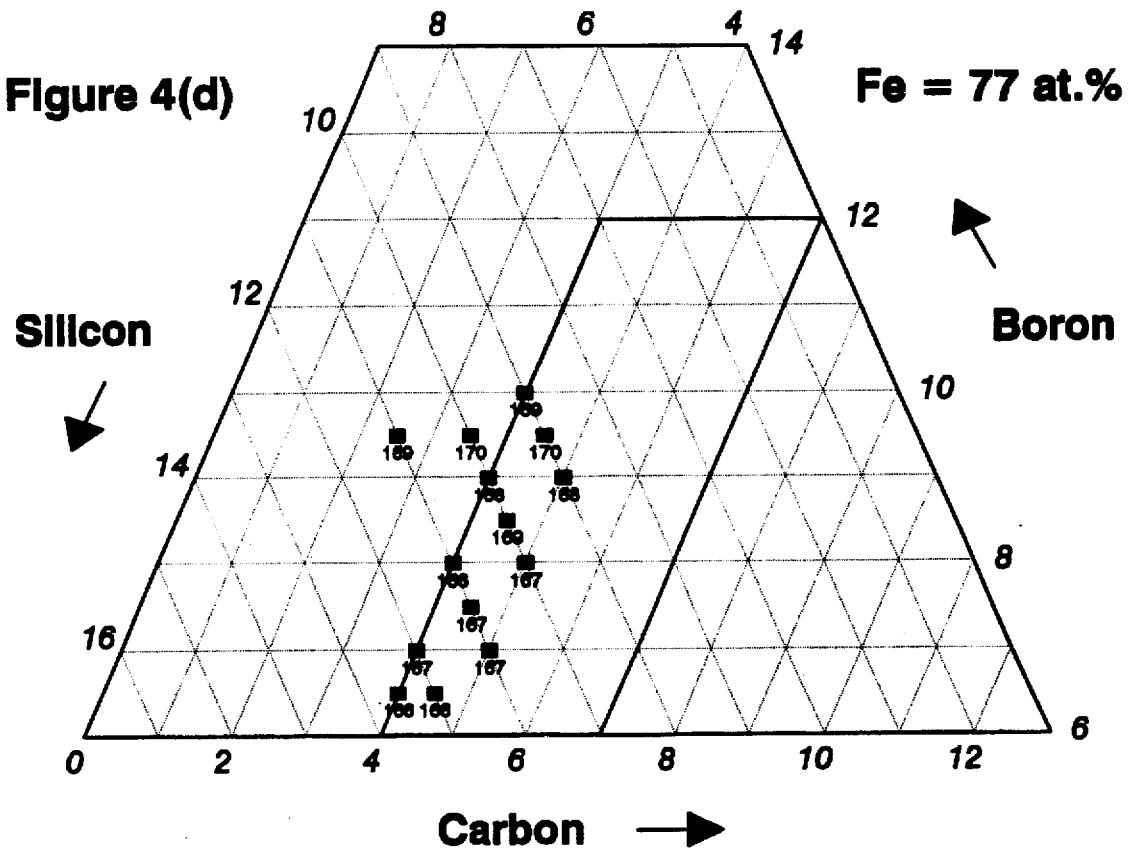

The present invention provides novel metallic alloys composed of iron, boron, silicon, and carbon, which are at least about 70% amorphous, and which consist essentially of the composition $Fe_aB_bSi_cC_d$, where "a"–"d" are in atomic percent, the sum of "a", "b", "c", and "d" equals 100, "a" ranges from about 77 to about 81, "b" is less than about 12, "c" is greater than about 3, and "d" is greater than about 0.5, the compositions being such that: in the ternary cross-section of the quaternary Fe-B-Si-C composition space at "a"=81, "b", "c" and "d" are in the region A, B, C, D, E, A, illustrated in FIG. 1(*a*); in the ternary cross-section of the quaternary Fe-B-Si-C composition space at "a"=80.5, "b", "c" and "d" are in the region A, B, C, D, E, F, A, illustrated in FIG. 1(*b*); in the ternary cross-section of the quaternary Fe-B-Si-C composition space at "a"=80, "b", "c" and "d" are in the region A, B, C, D, E, A, illustrated in FIG. 1(*c*); in the ternary cross-section of the quaternary Fe-B-Si-C composition space at "a"=79.5, "b", "c" and "d" are in the region A, B, C, D, E, F, A, illustrated in FIG. 1(*d*); in the ternary cross-section of the quaternary Fe-B-Si-C composition space at "a"=79, "b", "c" and "d" are in the region A, B, C, D, E, F, A, illustrated in FIG. 1(*e*); in the ternary cross-section of the quaternary Fe-B-Si-C composition space at "a"=78.5, "b", "c" and "d" are in the region A, B, C, D, E, F, A, illustrated in FIG. 1(*f*); in the ternary cross-section of the quaternary Fe-B-Si-C composition space at "a"=78, "b", "c" and "d" are in the region A, B, C, D, E, A, illustrated in FIG. 1(*g*); in the ternary cross-section of the quaternary Fe-B-Si-C composition space at "a"=77.5, "b", "c" and "d" are in the region A, B, C, D, E, A, illustrated in FIG. 1(*h*); and, in the ternary cross-section of the quaternary Fe-B-Si-C composition space at "a"=77, "b", "c" and "d" are in the region A, B, C, D, A, illustrated in FIG. 1(*i*). More specifically, referring to FIG. 1, the compositions of the alloys defining the corners of the various polygons that delimit the alloys of the invention as described above, are as follows: in the ternary cross-section of the quaternary Fe-B-Si-C composition space at 81 atomic percent Fe, the corners are defined by the alloys $Fe_{81}B_{11.5}Si_7C0.5$, $Fe_{81}B_{11.5}Si_3C_{4.5}$, $Fe_{81}B_{11}Si_3C_5$, $Fe_{81}B_{9.5}Si_{4.5}C_5$, $Fe_{81}B_{9.5}Si_9C_{0.5}$, and $Fe_{81}B_{11.5}Si_7C_{0.5}$; in the ternary cross-section of the quaternary Fe-B-Si-C composition space at 80.5 atomic percent Fe, the corners are defined by the alloys $Fe_{80.5}B_{11.75}Si_{7.25}C_{0.5}$, $Fe_{80.5}B_{11.75}Si_3C_{4.75}$, $Fe_{80.5}B_{11}Si_3C_{5.5}$, $Fe_{80.5}B_{8.75}Si_{5.25}C_{5.5}$, $Fe_{80.5}BS.75SiSC_{2.75}$, $Fe_{80.5}BllSi_8C_{0.5}$, and $Fe_{80.5}B_{11.75}Si_{7.25}C_{0.5}$; in the ternary cross-section of the quaternary Fe-B-Si-C composition space at 80 atomic percent Fe, the corners are defined by the alloys $Fe_{80}B_{12}Si_{7.5}C_{0.5}$, $Fe_{80}B_{12}Si_{3.25}C_{4.75}$, $Fe_{80}B_8Si_{7.25}C_{4.75}$, $Fe_{80}B_8Si_8C_4$, $Fe_{80}B_{11.5}Si_8C_{0.5}$, and $Fe_{80}B_{12}Si_{7.5}C_{0.5}$; in the ternary cross-section of the quaternary Fe-B-Si-C composition space at 79.5 atomic percent Fe, the corners are defined by the alloys $Fe_{79.5}B_{12}Si_8C_{0.5}$, $Fe_{79.5}B_{12}Si_3\ C_{5.5}$, $Fe_{79.5}B_{11}Si_3\ C_{6.5}$, $Fe_{79.5}B_{7.5}Si_{6.5}C_{6.5}$, $Fe_{79.5}B_{7.5}Si_{9.5}C_{3.5}$, $Fe_{79.5}B_9SiSC_{3.5}$, and $Fe_{79.5}B_{12}Si_8C_{0.5}$; in the ternary cross-section of the quaternary Fe-B-Si-C composition space at 79 atomic percent Fe, the corners are defined by the alloys $Fe_{79}B_{12}Si_{7.5}C_{1.5}$, $Fe_{79}B_{12}Si_3C_6$, $Fe_{79}B_{11}Si_3C_7$, $Fe_{79}B_7Si_7C_7$, $Fe_{79}B_7Si_{10}C_4$, $Fe_{79}B_{9.5}\ Si_{7.5}C_4$, and $Fe_{79}B_{12}Si_8C_1$; in the ternary cross-section of the quaternary Fe-B-Si-C composition space at 78.5 atomic percent Fe, the corners are defined by the alloys $Fe_{78.5}B_{12}Si_8C_{1.5}$, $Fe_{78.5}B_{12}Si_3C_{6.5}$, $Fe_{78.5}B_{11.5}Si_3C_7$, $Fe_{78.5}B_{6.5}SiSC_7$, $Fe_{78.5}B_{6.5}Si_{11.5}C_{3.5}$, $Fe_{78.5}B_{10}Si_8C_{3.5}$, and $Fe_{78.5}B_{12}Si_8C_{1.5}$; in the ternary cross-section of the quaternary Fe-B-Si-C composition space at 78 atomic percent Fe, the corners are defined by the alloys $Fe_{78}B_{12}Si_{7.75}C_{2.25}$, $Fe_{78}B_{12}Si_3C_7$, $Fe_{78}B_{6.5}Si_{8.5}C_7$, $Fe_{78}B_{6.5}Si_{11.75}C_{3.75}$, $Fe_{78}B_{10.5}Si_{7.75}C_{3.75}$, and $Fe_{78}B_{12}Si_{7.75}C_{2.25}$; in the ternary cross-section of the quaternary Fe-B-Si-C composition space at 77.5 atomic percent Fe, the corners are defined by the alloys $Fe_{77.5}B_{12}Si_{7.5}C_3$, $Fe_{77.5}B_{12}Si_{3.5}C_7$, $Fe_{77.5}B_6Si_{9.5}C_7$, $Fe_{77.5}B_6Si_{12.5}C_4$, $Fe_{77.5}B_{11}Si_{7.5}C_4$, and $Fe_{77.5}B_{12}Si_{7.5}C_3$; and, in the ternary cross-section of the quaternary Fe-B-Si-C composition space at 77 atomic percent Fe, the corners are defined by the alloys $Fe_{77}B_{12}Si_7C_4$, $Fe_{77}B_{12}Si_4C_7$, $Fe_{77}B_6Si_{10}C_7$, $Fe_{77}B_6Si_{13}C_4$, and $Fe_{77}B_{12}Si_7C_4$. It should be understood, however, that the compositions which delimit the boundaries of the polygons at various iron contents, as described above, may vary in B, Si, and C by as much as ±0.1 atomic percent. The Fe content, itself, could vary by as much as ±0.2 atomic percent.

The boundaries of the polygons delimiting the compositions of the alloys of this invention as specified above have referred to ternary cross-sections of the quaternary Fe-B-Si-C composition space for values of Fe content in 0.5 atomic percent step increments between the values 77 and 81 atomic percent. For other values of iron content between 77 and 81 atomic percent in an alloy of this invention, the boundaries of the delimiting polygons may be obtained by a simple, linear interpolation between the limiting values for B, Si, and C that define the delimiting polygons for the two immediately neighboring values for iron content that have been explicitly called out above. A specific illustration of this interpolation procedure follows: Let the iron content of interest be 79.25 atomic percent. The two immediately neighboring values of iron content that have been explicitly called out above are 79.5 and 79 atomic percent, and, therefore, the delimiting polygons specified above for these two values of iron should be used for the interpolation to obtain the range of alloys of this invention at 79.25 atomic percent iron. Referring to FIG. 1(*d*) for the iron content, "a", of 79.5 atomic percent, the carbon content, "d", has the limiting values of 0.5 and 5.5 atomic percent at a boron content, "b", of 12 atomic percent. Similarly, referring to FIG. 1(*e*) for "a"=79 atomic percent, the limiting values for "d" are 1.5 and 6 atomic percent, at the same value for "b" of 12 atomic percent. The value 79.25 atomic percent is halfway between the 79.5 and 79 atomic percent. Therefore, in an alloy of this invention which contains 79.25 atomic percent iron, the limiting values for the carbon content are 1 and 5.75 atomic percent (halfway between 0.5 and 1.5 atomic percent, and between 5.5 and 6 atomic percent, respectively), when such an alloy contains 12 atomic percent boron. Similar interpolations may easily be performed at other values for the boron content, using FIGS. 1(*d*) and 1(*e*). The loci of these limiting values thus derived would then specify the delimiting polygon that encompasses the alloys of this invention when the iron content is 79.25 atomic percent. Since the B and C contents have been specified for a particular iron content, the Si contents are automatically specified. As additional examples, for an Fe content, "a", of 78.7 atomic percent, the above detailed linear interpolation will be performed using the specified polygons for "a"–78.5 and "a"=79; for "a"=77.1, the specifications for "a"=77 and "a"=77.5 will be used; and, so on.

The alloys of this invention evidence the combination of a crystallization temperature of at least about 465° C., a Curie temperature of at least about 360° C., a saturation magnetization corresponding to a magnetic moment of at least about 165 emu/g and, a core loss not greater than about 0.35 W/kg and an exciting power value not greater than about 1 VA/kg, when measured at 25° C., 60 Hz and 1.4 T, after the alloys have been annealed at a temperature within the range of about 330° C.–390° C., for a time ranging between about 0.5 and 4 hours, in the presence of a magnetic field in the range of 5–30 Oe.

The preferred alloys of the invention have a composition such that: in the ternary cross-section of the quaternary Fe-B-Si-C composition space at "a"=81, "b", "c" and "d" are in the region A, B, C, 2, 1, A, illustrated in FIG. 1(*a*); in the ternary cross-section of the quaternary Fe-B-Si-C composition space at "a"=80.5, "b", "c" and "d" are in the region A, B, C, D, 2, 1, A, illustrated in FIG. 1(*b*); in the ternary cross-section of the quaternary Fe-B-Si-C composition space at "a"=80, "b", "c" and "d" are in the region A, B, C, D, 1, A, illustrated in FIG. 1(*c*); in the ternary cross-section of the quaternary Fe-B-Si-C composition space at "a"=79.5, "b", "c" and "d" are in the region 1, 2, C, D, 3, 4, 1, illustrated in FIG. 1(*d*); in the ternary cross-section of the quaternary Fe-B-Si-C composition space at "a"=79, "b", "c" and "d" are in the region 1, C, D, E, F, 1, illustrated in FIG. 1(*e*); in the ternary cross-section of the quaternary Fe-B-Si-C composition space at "a"=78.5, "b", "c" and "d" are in the region 1, C, D, 2, 3, 1, illustrated in FIG. 1(*f*); in the ternary cross-section of the quaternary Fe-B-Si-C composition space at "a"=78, "b", "c" and "d" are in the region 1, 2, 3, 4, 1, illustrated in FIG. 1(*g*); in the ternary cross-section of the quaternary Fe-B-Si-C composition space at "a"=77.5, "b", "c" and "d" are in the region E, 1, C, D, E, illustrated in FIG. 1(*h*); and, in the ternary cross-section of the quaternary Fe-B-Si-C composition space at "a"=77, "b", "c" and "d" are in the region 1, 2, C, D, 1, illustrated in FIG. 1(*i*). Here, the polygon corners identified with letters of the alphabet respectively represent the compositions as already specified for the corresponding value for "a", the iron content. The new, preferred corners identified with numerals 1, 2, etc. are specifically described by the following alloy compositions, again referring to FIG. 1: in the ternary cross-section at "a"=81, the corners 1 and 2 represent the compositions $Fe_{81}B_{10}Si_{8.5}C_{0.5}$ and $Fe_{81}B_{10}Si_4C_5$, respectively; in the ternary cross-section at "a"=80.5, the corners 1 and 2 represent the compositions $Fe_{80.5}B_{11.25}Si_{7.75}C_{0.5}$ and $Fe_{80.5}B_{8.75}Si_{7.75}C_3$, respectively; in the ternary cross-section at "a"=80, the corner 1 represents the composition $Fe_{80}BS.5Si_{7.5}C_4$; in the ternary cross-section at "a"=79.5, the corners 1, 2, 3, and 4 represent the compositions $Fe_{79.5}B_{11.5}Si_{7.5}C_{1.5}$, $Fe_{79.5}B_{11.5}Si_3C_6$, $Fe_{79.5}B_{7.5}Si_9C_4$ and $Fe_{79.5}B_9Si_{7.5}C_4$, respectively; in the ternary cross-section at "a"=79, the corner 1 represents the composition $Fe_{79}B_{11}Si_{7.5}C_{2.5}$; in the ternary cross-section at "a" =78.5, the corners 1, 2, and 3 represent the compositions $Fe_{78.5}B_{11.5}Si_{7.5}C_{2.5}$, $Fe_{78.5}B_{6.5}Si_{11}C_4$, and $Fe_{78.5}B_{10}Si_{7.5}C_4$, respectively; in the ternary cross-section at "a"=78, the corners 1, 2, 3, and 4 represent the compositions $Fe_{78}B_{11}Si_7C_4$, $Fe_{78}B_{11}Si_5C_6$, $Fe_{78}B_{6.5}Si_{9.5}C_6$, and $Fe_{78}B_{6,}SSi_{11.5}C_4$, respectively; in the ternary cross-section at "a"= 77.5, the corner 1 represents the composition $Fe_{77.5}B_{11}Si_{4.5}C_7$; and, in the ternary cross-section at "a"=77, the corners 1 and 2 represent the compositions $Fe_{77}B_{11}Si_8C_4$ and $Fe_{77}B_{11}Si_5C_7$, respectively. The compositions which delimit the boundaries of the polygons for the preferred alloys of this inventions at various iron contents, as described above, may vary by as much as ±0.1 atomic percent in all constituent elements. For other values of iron content between 77 and 81 atomic percent in the preferred alloys of this invention, the boundaries of the delimiting polygons may be obtained by employing the above detailed procedures for a linear interpolation between the limiting values for B, Si, and C defining the delimiting polygons for the two immediately neighboring values for iron content that have been explicitly called out above.

In these preferred alloys of the invention, higher crystallization temperatures (greater than about 480° C.), higher Curie temperatures (greater than about 370° C.), and lower core losses (less than about 0.28 W/kg at 60 Hz and 1.4 T at 25° C.) are obtained.

The more preferred alloys of this invention consist essentially of the composition $Fe_aB_bSi_cC_d$, where "a"–"d" are in atomic percent, the sum of "a", "b", "c", and "d" equals 100, "a" ranges between about 79 and 80.5, "b" ranges between about 8.5 and 10.25, and "d" ranges between about 3.25 and 4.5, with the maximum silicon content "c" defined by the appropriate delimiting polygons as defined above for the preferred alloys of the invention. In these more preferred alloys of the invention, the crystallization temperatures are at least about 495° C., and often higher than about 505° C., the saturation magnetization values correspond to a magnetic moment of at least about 170 emu/g, and often to magnetic moments of about 174 emu/g, and the core losses are particularly low, typically lower than about 0.25 W/kg at 60 Hz and 1.4 T at 25° C., and often lower than about 0.2 W/kg under the same conditions. Examples of the more preferred alloys of the invention include $Fe_{79.5}B_{9.25}Si_{7.5}C_{3.75}$, $Fe_{79}B_{8.5}Si_{8.5}C_4$, and $Fe_{79.1}B_{8.9}Si_8C_4$.

A still more preferred alloy of the invention consists essentially of the composition $Fe_aB_bSi_cC_d$, where "a", "b", "c", and "d" are in atom percent, the sum of "a", "b", "c", and "d" equals 100, "a" ranges between about 79 and 80.5, "b" ranges between about 8.5 and 10.25, "d" ranges between about 3.25 and 4.5, and "c" is defined by the appropriate delimiting polygons as defined above for the preferred alloys of the invention, with the further proviso that "c" is at least about 6.5. Such an alloy exhibits a combination of high crystallization temperature of at least about 495° C., high saturation magnetization value corresponding to a magnetic moment of at least about 170 emu/g, and core loss and exciting power below 0.15 W/kg and 0.5 VA/kg, respectively, measured at 25° C., 1.4 T, and 60 Hz. Examples of the still more preferred alloy include $Fe_{80.2}B_{9.2}Si_{7.0}C_{3.6}$, $Fe_{80.1}B_{9.1}$, $Si_{7.0}C_{3.8,}Fe_{80.1}B_{9.2}Si_{7.0}C_{3.7}$, and $Fe_{80.2}B_{9.1}Si_{7.0}C_{3.7}$.

The purity of the alloys of the present invention is, of course, dependent upon the purity of the materials employed to produce the alloys. Raw materials which are less expensive and, therefore contain a greater impurity content, could be desirable to ensure large scale production economics, for example. Accordingly, the alloys of this invention can contain as much as 0.5 atomic percent of impurities, but preferably contain not more than 0.3 atomic percent of impurities. Here, all elements apart from Fe, B, Si, and C are considered as impurities. The impurity content would, of course, modify the actual levels of the primary constituents in the alloys of the invention from their intended values. However, it is anticipated that the ratios of the proportions of Fe, B, Si, and C will be maintained.

Metallic alloy chemistry can be determined by various means known in the art including inductively coupled plasma emission spectroscopy (ICP), atomic absorption spectroscopy (AAS), and classical wet chemistry (gravimetric) analysis. Because of its simultaneous analysis capability, ICP is a method of choice in industrial laboratories. An expeditious mode for operating an ICP system is the "concentration ratio" mode, in which a series of selected major and impurity elements is simultaneously analyzed directly and the major constituent is calculated by the difference between 100 percent and the elements analyzed. Thus, impurity elements for which there is no direct measurement in the ICP system are reported as part of the calculated major element content. That is, the true content of major element in a metallic alloy analyzed by ICP in the concentration ratio mode is actually slightly less than that calculated due to the presence of very low levels of impurities which are not directly measured. The alloy chemistries of the present invention pertain to the relative amounts of Fe, B, Si, and C, normalized to 100 percent. Impurity element contents are not considered to be comprised in the sum of major elements adding up to 100 percent.

As is well known, the magnetic properties of alloys cast to a metastable state generally improve with increased volume percent of amorphous phase. Accordingly, the alloys of this invention are cast so as to be at least about 70% amorphous, preferably at least about 90% amorphous, and most preferably essentially 100% amorphous. The volume percent of amorphous phase in the alloy is conveniently determined by x-ray diffraction.

The compositions of various Fe-B-Si-C alloys that were actually cast are shown in FIGS. 2(*a*)–2(*g*) or 3(*a*)–3(*g*). All of the alloys recited here were cast as 6 mm wide ribbons, in 50–100 g batches, in accordance with the following procedure: The alloys were cast on a hollow, rotating cylinder, open at one side thereof. The cylinder had an outer diameter of 25.4 cm and a casting surface having a thickness of 0.25" (0.635 cm) and a width of 2" (5.08 cm). The cylinder was made from a Cu-Be alloy produced by Brush-Wellman (designated Brush-Wellman Alloy 10). The constituent elements of the alloys tested were mixed in appropriate proportions, starting from high purity (B=99.9%, and Fe and Si at least 99.99% pure) raw materials, and melted in a 2.54 cm diameter quartz crucible to yield homogenized, pre-alloyed ingots. These ingots were loaded into a second quartz crucible (2.54 cm diameter), with the bottom ground flat and containing a rectangular slot of dimensions 0.25"× 0.02" (0.635 cm×0.051 cm), positioned 0.008" (≈0.02 cm) from the casting surface of the cylinder. The cylinder was rotated at a peripheral speed of about 9,000 feet per minute (45.72 m/s). The second crucible and wheel were enclosed within a chamber pumped down to a vacuum of about 10 mm Hg. The top of the crucible was capped and a slight vacuum was maintained in the crucible (a pressure of about 10 mm Hg). A power supply (Pillar Corporation 10 kW), operating at about 70% of peak power, was used to induction melt each of the ingots. When the ingot was fully molten, the vacuum in the crucible was released, enabling the melt to contact the wheel surface and be subsequently quenched into ribbons about 6 mm wide via the principle of planar flow casting disclosed in U.S. Pat. No. 4,142,571, which is incorporated herein by reference thereto.

Some of the alloy compositions belonging to the invention, as well as some alloy compositions outside the scope of the invention, were also cast as ribbons ranging in width between about 1" and 5.6" on larger casting machines, in batches ranging from about 5–1000 kg. The principle of planar flow casting was still used. The sizes of the crucibles and pre-alloyed ingots, and various casting parameters, were, of necessity, different from those described above. Furthermore, due to the higher heat loads, different casting substrate materials were also employed. In many instances in the case of the larger casting runs, the intermediate step of the pre-alloyed ingot was dispensed with, and/or raw materials of commercial purity were employed. In instances when commercial, high grade raw materials were used, chemical analysis on the cast ribbons revealed that the impurity content ranged between about 0.2 and 0.4 percent by weight. Some of the trace elements detected, such as Ti, V, Cr, Mn, Co, Ni, and Cu, have atomic weights comparable to that of Fe, while other detected elements, such as Na, Mg, Al, and P, are comparable to Si in atomic weight. The heavy elements detected were Zr, Ce, and W. Given this distribution, it is estimated that the detected total of 0.2 to 0.4 weight percent corresponds to a range of about 0.25 to 0.5 atomic percent for the impurity content.

It was generally found that when the B and/or the Si contents were lower, and/or the C content higher, than the respective limits specified for the alloys of this invention, the resulting alloys were unacceptable for a variety of reasons. In many instances, these alloys were brittle and difficult to handle, even in the as-cast state. In other instances, it was found that the melt was difficult to homogenize, with the result that the control of the composition in the cast ribbon was difficult. Even though, with great care and effort, some of these chemistries could be made into ductile ribbons with the correct composition, such alloy compositions would surely not be amenable to large scale continuous production of acceptable ribbons, and, therefore, these alloys are undesirable.

As discussed previously, because of the very high cost of boron as a raw material, higher boron levels than prescribed here for the alloys of the invention are economically unattractive, and, therefore, not desired. The FIGS. 2 also contain the measured values of the crystallization temperatures, and the FIGS. 3 provide the measured values of the Curie temperatures of these alloys. In each of these figures, the delimiting polygons for the basic alloys of this invention are also shown for reference.

The crystallization temperature of these alloys was determined by Differential Scanning Calorimetry. A scanning rate of 20 K/min was used, and the crystallization temperature was defined as the temperature of onset of the crystallization reaction.

The Curie temperature was determined using an inductance technique. Multiple helical turns of high temperature, ceramic-insulated copper wire, identical in all respects (length, number and pitch), were wound onto two open-ended quartz tubes. The two sets of windings thus prepared had the same inductance. The two quartz tubes were placed in a tube furnace, and an AC exciting signal (with a fixed frequency ranging between about 2 kHz and 10 kHz) was applied to the prepared inductors, and the balance (or difference) signal from the inductors was monitored. A ribbon sample of the alloys to be measured was inserted into one of the tubes, serving as the "core" material for that inductor. The high permeability of the ferromagnetic core material caused an imbalance in the values of the inductances and, therefore, a large signal. A thermocouple attached to the alloy ribbon served as the temperature monitor. When the two inductors were heated up in an oven, the imbalance signal essentially dropped to zero when the ferromagnetic metallic glass passed through its Curie temperature and became a paramagnet (low permeability). The two inductors then yielded about the same output. The transition region is usually broad, reflecting the fact that the stresses in the as-east glassy alloy are relaxing. The midpoint of the transition region was defined as the Curie temperature.

In the same fashion, when the oven was allowed to cool, the paramagnetic-to-ferromagnetic transition could be detected. This transition, from the at least partially relaxed glassy alloy, was usually much sharper. The paramagnetic-to-ferromagnetic transition temperature was higher than the ferromagnetic-to-paramagnetic transition temperature for a given sample. The quoted values in the FIGS. 3 for the Curie temperatures represent the paramagnetic-to-ferromagnetic transition.

The importance of high crystallization and Curie temperatures has to do with the efficient accomplishment of necessary anneals on the as-east amorphous metallic alloy strips.

In the production of magnetic cores from amorphous metallic alloy strip (metallic glass) for use in distribution and power transformers, the metallic glass, either before or after being wound into a core, is subjected to annealing. Annealing (or, synonymously, heat treatment), usually in the presence of an applied magnetic field, is necessary before the metallic glass will display its excellent soft magnetic characteristics, because as-cast metallic glasses exhibit a high degree of quenched-in stress which causes significant stress-induced magnetic anisotropy. This anisotropy masks the true soft magnetic properties of the product and is removed by annealing the product at suitably chosen temperatures at which the induced quenched-in stresses are relieved. Obviously, the annealing temperature must be below the crystallization temperature. Since annealing is a dynamic process, the higher the annealing temperature, the shorter the time period needed to anneal the product. For these and other reasons to be explained below, the optimum annealing temperature is presently in the narrow range of from about 140 K to 100 K below the crystallization temperature of the metallic glass, and the optimum annealing time is about 1.5–2.5 hours; for large cores, that is, cores having mass in excess of 50 kg, somewhat longer times ranging up to about 4 hours may be required.

Metallic glasses exhibit no magnetocrystalline anisotropy, a fact attributable to their amorphous nature. However, in the production of magnetic cores, especially those for use in distribution transformers, it is highly desirable to maximize the magnetic anisotropy of the alloy along a preferred axis aligned with the length of the strip. In fact, presently, it is believed to be the preferred practice of transformer core manufacturers to apply a magnetic field to the metallic glass during the annealing step in order to induce a preferred axis of magnetization.

The field strength ordinarily applied during annealing is sufficient to saturate the material in order to maximize the induced anisotropy. Considering that the saturation magnetization value decreases with increasing temperature until the Curie 11.5 temperature is reached, above which temperature no further modification of magnetic anisotropy is possible, annealing is preferably carried out at temperatures close to the Curie temperature of the metallic glass so as to maximize the effect of the external magnetic field. Of course, the lower the annealing temperature, the longer the time (and higher the applied magnetic field strength) necessary to relieve the cast-in stresses and to induce a preferred anisotropy axis.

It should be apparent from the above discussion that selection of the annealing temperature and time depends in large part on the crystallization temperature and Curie temperature of the material. In general, the higher these temperatures are, the higher the anneal temperatures could be and, therefore, the anneal process could be accomplished in a shorter time.

It is noted from the FIGS. 2 and 3 that the crystallization and Curie temperatures generally increase with decreasing iron content. In addition, for a given iron content, the crystallization temperature generally decreases with a decrease in the boron content. Iron contents higher than about 81 atomic percent are not desirable; both the crystallization and the Curie temperatures would be adversely affected.

This increase is approximately in the range of 20°–25° C. in the crystallization temperature, and approximately in the range of 10°–15° C. in the Curie temperature, per atomic percent decrease in iron content.

Such a smooth dependence of these temperatures on the iron content is a distinguishing, and desirable, characteristic of the alloys of this invention. For example, during the course of large scale production of these materials, the reasonably rapid measurement of the crystallization temperature could be used as a quality control tool on the composition of the cast ribbon. Actual evaluation of the chemistries is a more time consuming process. In addition, the characteristic of a smooth dependence of material properties on the composition is preferable for the commercial scale production of materials, where, of necessity, the alloy composition cannot be controlled to specifications as tight as in a laboratory.

A crystallization temperature of at least 465° C. is necessary in an amorphous alloy useful as magnetic core material in a transformer to ensure that, during annealing or in use in a transformer (particularly in the event of a current overload), the risk of inducing crystallization into the alloy is minimized. As stated previously, the Curie temperature of an amorphous alloy should be close to, and preferably slightly higher than, the temperature employed during annealing. The closer the annealing temperature is to the Curie temperature, the easier it is to align the magnetic domains in a preferred axis, thus minimizing the losses exhibited by the alloys when magnetized along that same axis. A useful transformer core alloy should have a Curie temperature of at least about 360° C.; lower values would result in lower anneal temperatures and long anneal times. However, very high Curie temperatures are also not very desirable. Anneal temperatures should not be too high for various reasons: at high anneal temperatures, control of anneal time becomes critical, because even a partial crystallization of the alloy has to be avoided, and, even if crystallization does not pose a potential problem, control of anneal time remains critical, so that the risk of substantial loss of ductility, and subsequent handleability, is minimized; additionally, as will be described later, anneal temperatures have to be "realistic", and not too high, in terms of ovens conventionally used to anneal large cores, and the necessary management of the attendant temperature gradients, to ensure useful and "optimal" cores. On the other hand, if the anneal temperatures are not increased when a high Curie temperature material is annealed, impractically large external fields will be required to ensure a favorable alignment of the magnetic domains.

While there may be other individual compositions, with higher silicon content than in the alloys of this invention, that have values for their crystallization and/or Curie temperatures which are comparable to those of the alloys of this invention, the dependence of these values on the alloy composition is more complex, and not as systematic as observed in the alloys of this invention. As may be noted from the FIGS. 2 and 3, when one ventures outside of the Si contents specified for the alloys of this invention, the crystallization or the Curie temperature tends to be generally sensitive to alloy composition; either the crystallization temperature drops or the Curie temperature increases. As discussed above, since the crystallization and Curie temperatures of an amorphous material help to define the anneal condition for the material, and since, in practice, these anneal conditions are strictly adhered to during the production of large transformer cores, alloy compositions wherein the material properties are not generally forgiving in terms of small variations in composition are not desirable.

It has been found that the saturation magnetic moment is a slowly varying function of the iron content in these alloys, decreasing in value as the iron content is decreased. This is illustrated by example in FIGS. 4(*a*)–4(*d*).

The values for the saturation magnetization quoted are those obtained from as-cast ribbons. It is well understood in the art that the saturation magnetization of an annealed metallic glass alloy is usually higher than that of the same alloy in the as-cast state, for the same reason as discussed previously: the glass is relaxed in the annealed state.

A commercial vibrating sample magnetometer was used for the measurement of the saturation magnetic moment of these alloys. As-cast ribbon from a given alloy was cut into several small squares (approximately 2 mm×2 mm), which were randomly oriented about a direction normal to their plane, their plane being parallel to maximum applied field of about 9.5 kOe. By using the measured mass density, the saturation induction, $B_s$, may then be calculated. Not all of the cast alloys were characterized for saturation magnetic moment. The density of many of these alloys was measured using standard techniques based upon Archimedes' Principle.

It is apparent from the FIGS. 4 that iron contents below about 77 atomic percent are not desirable, since the saturation magnetic moments fall to unacceptably low levels. Since electrical distribution transformers are usually designed to operate at 90% of the available saturation induction at 85° C., and since a higher design induction generally leads to more compact magnetic cores, a high saturation moment, and, therefore, high saturation induction, in combination with a high Curie temperature is important from a transformer core designer's point of view.

The saturation magnetic moment in an alloy useful as transformer core material should be at least about 165 emu/g, and preferably about 170 emu/g. Since Fe-B-Si-C alloys generally have a greater mass density than Fe-B-Si alloys, the above numbers would be consistent with established criteria for Fe-B-Si alloys for use as transformer core materials. It is noted from the FIGS. 4 that some of the most preferred alloys of the invention have these moments to be as high as 175 emu/g.

In addition to factors such as crystallization and Curie temperatures, an important consideration in selecting annealing temperature and time is the effect of the anneal on the ductility of the product. In the manufacture of magnetic cores for distribution and power transformers, the metallic glass must be sufficiently ductile so as to be wound or assembled into the core shape and to enable it to be handled after having been annealed, especially during subsequent transformer manufacturing steps such as the step of lacing the annealed metallic glass through the transformer coil. (For a detailed discussion of the process of manufacturing transformer core and coil assemblies see, for example, U.S. Pat. No. 4,734,975).

Annealing of an iron-rich metallic glass results in degradation of the ductility of the alloy. While the mechanism responsible for degradation prior to crystallization is not clear, it is generally believed to be associated with the dissipation of the "free volume" quenched into the as-cast metallic glass. The "free volume" in a glassy atomic structure is analogous to vacancies in a crystalline atomic structure. When a metallic glass is annealed, this "free volume" is dissipated as the amorphous structure tends to relax into a lower energy state represented by a more efficient atomic "packing" in the amorphous state. Without wishing to be bound by any theory, it is believed that since the packing of Fe-base alloys in the amorphous state more closely resembles that of a face centered cubic structure (a close-packed crystalline structure) rather than the body centered cubic structure of iron, the more relaxed the iron-base metallic glass, the more brittle it is (i.e., less able it is to tolerate external strain). Therefore, as the annealing temperature and/or time increase, the ductility of the metallic glass decreases. Consequently, apart from the fundamental issue of alloy composition, one must consider the effects of annealing temperature and time to further ensure that the product retains sufficient ductility to be used in the production of transformer cores.

The two most important characteristics of the performance of a transformer core are the core loss and exciting power of the core material. When magnetic cores of annealed metallic glass are energized (i.e., magnetized by the application of a magnetic field) a certain amount of the input energy is consumed by the core and is lost irrevocably as heat. This energy consumption is caused primarily by the energy required to align all the magnetic domains in the metallic glass in the direction of the field. This lost energy is referred to as core loss, and is represented quantitatively as the area circumscribed by the B-H loop generated during one complete magnetization cycle of the material. The core loss is ordinarily reported in units of W/kg, which actually represents the energy lost in one second by a kilogram of material under the reported conditions of frequency, core induction level and temperature.

Core loss is affected by the annealing history of the metallic glass. Put simply, core loss depends upon whether the glass is under-annealed, optimally annealed or over-annealed. Under-annealed glasses have residual, quenched-in stresses and related magnetic anisotropies which require additional energy during magnetization of the product and result in increased core losses during magnetic cycling. Over-annealed alloys are believed to exhibit maximum "packing" and/or can contain crystalline phases, the result of which is a loss of ductility and/or inferior magnetic properties such as increased core loss caused by increased resistance to movement of the magnetic domains. Optimally annealed alloys exhibit a fine balance between ductility and magnetic properties. Presently, transformer manufacturers utilize amorphous alloy exhibiting core loss values of less than 0.37 W/kg (60 Hz and 1.4 T at 25° C.).

Exciting power is the electrical energy required to produce a magnetic field of sufficient strength to achieve in the metallic glass a given level of magnetization. An as-cast iron-rich amorphous metallic alloy exhibits a B-H loop which is somewhat sheared over. During annealing, as-cast anisotropies and cast-in stresses are relieved, the B-H loop becomes more square and narrower relative to the as-cast loop shape until it is optimally annealed. Upon over-annealing, the B-H loop tends to broaden as a result of reduced tolerance to strain and, depending upon the degree of over-annealing, existence of crystalline phases. Thus, as the annealing process for a given alloy progresses from under-annealed to optimally annealed to over-annealed, the value of H for a given level of magnetization initially decreases, then reaches an optimum (lowest) value, and thereafter increases. Therefore, the electrical energy necessary to achieve a given magnetization (the exciting power) is minimized for an optimally-annealed alloy. Presently, transformer core manufacturers employ amorphous alloy exhibiting exciting power values at 60 Hz and 1.4 T (at 25° C.) of about 1 VA/kg or less.

It should be apparent that optimum annealing conditions are different for amorphous alloys of different compositions, and for each property required. Consequently, an "optimum" anneal is generally recognized as that annealing process which produces the best balance between the combination of characteristics necessary for a given application. In the case of transformer core manufacture, the manufacturer determines a specific temperature and time for annealing which are "optimum" for the alloy employed and does not deviate from that temperature or time.

In practice, however, annealing furnaces and furnace control equipment are not precise enough to maintain exactly the optimum annealing conditions selected. In addition, because of the size of the cores (typically 200 kg) and the configuration of furnaces, cores may not heat uniformly, thus producing over-annealed and under-annealed core portions. Therefore, it is of utmost importance not only to provide an alloy which exhibits the best combination of properties under optimum conditions, but also to provide an alloy which exhibits that "best combination" over a range of annealing conditions. The range of annealing conditions under which a useful product can be produced is referred to as an "annealing (or anneal) window".

As stated earlier, the optimum annealing temperature and time for metallic glass presently used in transformer manufacture is a temperature in the range of 140°–100° C. below the crystallization temperature of the alloy, for a time of between 1.5–2.5 hours.

The alloys of the present invention offer an annealing window of about 20°–25° C. for the same optimum anneal time. Thus, alloys of the present invention can be subjected to annealing temperature variations of about ±10° C. from the optimum annealing temperature and still retain the combination of characteristics essential to the economical production of transformer cores. Moreover, the alloys of the present invention show unexpectedly enhanced stability in each of the characteristics of the combination over the range of the anneal window; a characteristic which enables the transformer manufacturer to more reliably produce uniformly performing cores.

It has been disclosed that the frequency dependence of the core loss L of soft magnetic cores under sinusoidal excitation at frequency f may be represented by the following equation:

$$L=af+bf^n+cf^2.$$

The term af is the dc hyseresis loss (the limiting value of loss as frequency approaches zero), the term $cf^2$ is the classical eddy current loss, and the term $bf^n$ represents the anomalous eddy current loss (see, e.g., G. E. Fish et al., J. Appl. Phys. 64, 5370 (1988)). Amorphous metals generally possess sufficiently high resistivity and low thickness that the classical eddy current losses may be neglected. Further, it has been disclosed that the exponent n for amorphous metals is often about 1.5. Without being bound by any theory, it is believed that this value of n is indicative that the number of domain walls active in the magnetization process varies with frequency. If the n=1.5 value is representative, the hysteresis coefficient a and the eddy current coefficient b may be extracted conveniently by plotting as a straight line the core loss per cycle L/f versus the square root of f. The f=0 intercept of the line is then a and the slope is b.

Quite unexpectedly, the inventors have found that cores comprised of prior art alloy and of alloy of the invention may exhibit quite a different balance between the hysteresis and eddy current components of loss. Therefore, cores of different material which have similar losses at one frequency may have quite different losses at another frequency. In particular, cores of the present invention show at line frequency a smaller value of eddy current loss but a higher value of hysteresis loss than similar cores of prior art amorphous metal. Therefore, total core losses of the present alloy which are only slightly lower at line frequency than those of prior art Fe-base alloy would be substantially lower at higher frequency. Such a difference makes the alloy and cores of the present invention especially advantageous for use in airborne electrical equipment operating at 400 Hz and in other electronic applications in the kilohertz range.

The alloy of the present invention is also advantageously employed in the construction of magnetic cores for filter inductors. It is well known in the art that a filter inductor may be employed in electronic circuitry to impede selectively passage of alternating current noise or ripple superimposed on a desired dc current. For such applications, the filter inductor core frequently comprises at least one gap in the magnetic circuit thereof. By suitable choice of the gap the hysteresis loop of the core may be sheared to increase within controlled bounds the magnetic field required to saturate the core. Otherwise, the dc current component passing through the inductor would drive its core to saturation, reducing the effective permeability seen by the ac current component and eliminating the desired filtering action. Although the flux excursion in the inductor core due to the ac current component passing through the winding thereof may be small, a large value of saturation magnetization is still important so a large dc current may pass without saturating the sheared B-H loop. As described in more detail above, the alloy of the invention preferably exhibits saturation magnetization of at least about 165 emu/g, and, more preferably, at least about 170 emu/g. Common means in the art for fabricating gapped cores include both radially cutting in one or more places a generally toroidally shaped core and assembling punched or stamped C-I or E-I laminations.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

Core loss and exciting power data were gathered from some representative alloy samples of the invention prepared as follows:

Toroidal samples for annealing, and subsequent magnetic measurements, were prepared by winding as-cast ribbons onto ceramic bobbins so that the mean path length of the ribbon core was about 126 mm. Insulated primary and secondary windings, each numbering 100, were applied to the toroids for the purpose of measurements of core loss. Toroidal samples so prepared contained between 3 and 10 g of ribbon in the case of 6 mm wide ribbons, and between 30 and 70 g for the wider ribbons. Annealing of these toroidal samples was carried out at 340°–390° C. for 1–2.5 hours in the presence of an applied field of about 5–30 Oe imposed along the length of the ribbon (toroid circumference). This field was maintained while the samples were cooled following the anneal. The anneals were conducted under vacuum.

The total core loss and exciting power were measured on these closed-magnetic-path samples under sinusoidal flux conditions using standard techniques. The frequency (f) of excitation was 60 Hz, and the maximum induction level ($B_m$) that the cores were driven to was 1.4 T.

The core losses and exciting powers obtained, at 60 Hz and 1.4 T at 25° C., from annealed cores of representative alloys of this invention, and of some alloys not within the scope of this invention, are provided in Tables II for ribbons annealed for 1 hour at various temperatures, and in Table III for ribbons annealed for 2 hours at various temperatures. The designations of the alloys in these Tables refer to the corresponding compositions provided in Table I. As is noted from that Table, the alloys designated as A-F are outside the scope of this invention. Not all of the alloys were annealed under all sets of conditions quoted in the Tables. It is noted from these Tables that, for most of the alloys of this invention, the core losses are lesser than about 0.3 W/kg. Such is not the case with the alloys not belonging to this invention. As mentioned previously, the core loss value presently specified by transformer manufacturers for their core material is about 0.37 W/kg. The exciting power values are also noted to be less than about 1 VA/kg, the value presently specified for transformer core materials. It is this combination of exciting power and core losses, in further combination with the other characteristics discussed previously, and the relative uniformity and consistency of the properties under a range of anneal conditions, which is a characteristic of, but unexpected from, alloys of the present invention. The anneal windows over which the advantageous combination of core performance characteristics is obtained are evident form the Tables II and III. It is particularly noted that, in the preferred range of chemistries for the alloys of this invention, the core losses can be as low as about 0.2–0.3 W/kg, and the exciting powers can be as low as about 0.25–0.5 VA/kg.

TABLE I

Compositions of alloys (in atomic percent) characterized for core loss and exciting power values. Alloys A–F are outside the scope of this invention. Alloys 1–6 were cast as 6 mm wide ribbons.

| Alloy | Fe | B | Si | C |
|---|---|---|---|---|
| 1 | 79 | 8 | 9 | 4 |
| 2 | 79.5 | 9.5 | 6.5 | 4.5 |
| 3 | 80 | 10 | 7 | 3 |
| 4 | 80 | 10 | 6 | 4 |
| 5 | 81 | 11 | 4.5 | 3.5 |
| 6 | 81 | 11.5 | 5.5 | 2 |
| G | 81.0 | 11.1 | 4.6 | 3.4 |
| H | 80.9 | 11.5 | 5.6 | 2.0 |
| I | 80.3 | 11.1 | 7.5 | 1.0 |
| J | 80.2 | 10.1 | 7.7 | 2.0 |
| K | 79.8 | 10.1 | 6.2 | 3.9 |
| L | 79.6 | 10.2 | 7.2 | 3.0 |
| M | 79.5 | 9.7 | 7.1 | 3.7 |
| N | 79.4 | 9.8 | 7.0 | 3.9 |
| 0 | 79.4 | 9.4 | 7.1 | 4.1 |
| P | 79.4 | 8.9 | 8.0 | 3.8 |
| Q | 79.3 | 9.8 | 6.5 | 4.4 |
| R | 79.3 | 9.8 | 7.6 | 3.3 |
| S | 79.2 | 9.5 | 7.6 | 3.8 |
| T | 78.9 | 8.4 | 8.9 | 3.8 |
| A | 79.3 | 9.6 | 9.6 | 1.4 |
| B | 79.1 | 9.2 | 8.3 | 3.4 |
| C | 79.0 | 9.2 | 10.4 | 1.4 |
| D | 78.9 | 8.3 | 9.3 | 3.6 |
| E | 78.7 | 8.8 | 9.9 | 2.9 |
| F | 78.6 | 9.2 | 9.4 | 2.9 |

TABLE II

Cores loss and exciting power values, measured at 60 Hz, 1.4 T, and 25° C., obtained from Fe—B—Si—C alloys following anneals for 1 hour at the various noted temperatures. The alloy designations are from Table I.

| | Cores Loss (W/kg) | | | Exciting Power (VA/kg) | | |
|---|---|---|---|---|---|---|
| Alloy | 340° C. | 360° C. | 380° C. | 340° C. | 360° C. | 380° C. |
| G | 0.16 | 0.18 | | 0.24 | 0.29 | |
| H | 0.20 | 0.22 | | 0.26 | 0.33 | |
| I | 0.27 | 0.23 | 0.22 | | 0.70 | 0.57 |
| J | 0.24 | 0.24 | 0.24 | | 0.35 | 0.36 |
| K | 0.26 | 0.21 | 0.20 | 0.71 | 0.31 | 0.27 |
| L | 0.27 | 0.18 | 0.22 | | 0.26 | 0.27 |
| M | 0.23 | 0.19 | 0.21 | | 0.28 | 0.30 |
| A | 0.32 | 0.26 | 0.25 | 4.37 | 1.64 | 1.13 |
| D | 0.32 | 0.27 | 0.30 | 3.46 | 1.21 | 0.70 |
| F | 0.30 | 0.23 | 0.23 | 3.90 | 1.68 | 0.79 |

TABLE III

Cores loss and exciting power values, measured at 60 Hz, 1.4 T. 25° C., obtained from Fe—B—Si—C alloys following anneals for 2 hours at the various noted temperatures. The alloy designations are from Table I

| | Cores Loss (W/kg) | | | Exciting Power (VA/kg) | | |
|---|---|---|---|---|---|---|
| Alloy | 340° C. | 360° C. | 380° C. | 340° C. | 360° C. | 380° C. |
| 1 | | 0.23 | 0.24 | | 0.86 | 0.80 |
| 2 | | 0.24 | 0.28 | | 0.68 | 0.75 |
| 3 | | 0.21 | 0.33 | | 0.46 | 0.56 |
| 4 | | 0.23 | | | 0.32 | |
| 5 | | 0.29 | | | 0.37 | |
| 6 | | 0.29 | | | 0.36 | |
| G | 0.15 | 0.26 | | 0.23 | 0.36 | |
| H | 0.21 | 0.28 | | 0.26 | 0.38 | |
| I | | 0.23 | 0.26 | | 0.73 | 0.86 |
| J | | 0.21 | 0.26 | | 0.28 | 0.34 |

TABLE III-continued

Cores loss and exciting power values, measured at 60 Hz, 1.4 T. 25° C., obtained from Fe—B—Si—C alloys following anneals for 2 hours at the various noted temperatures. The alloy designations are from Table I

| | Cores Loss (W/kg) | | | Exciting Power (VA/kg) | | |
|---|---|---|---|---|---|---|
| Alloy | 340° C. | 360° C. | 380° C. | 340° C. | 360° C. | 380° C. |
| K | | 0.21 | 0.26 | | 0.28 | 0.34 |
| L | | 0.18 | 0.22 | | 0.24 | 0.34 |
| M | | 0.18 | 0.21 | | 0.24 | 0.27 |
| N | | 0.22 | | | 0.43 | |
| 0 | | 0.23 | | | 0.75 | |
| P | | 0.25 | | | 0.80 | |
| Q | | 0.20 | | | 0.33 | |
| R | | 0.25 | | | 0.78 | |
| S | | 0.22 | | | 0.37 | |
| T | | 0.28 | | | 0.48 | |
| A | | 0.26 | 0.30 | | 1.49 | 2.02 |
| B | | 0.31 | 0.39 | | 0.37 | 0.47 |
| C | | 0.37 | 0.41 | | 1.00 | 2.60 |
| D | | 0.31 | 0.32 | | 0.63 | 1.50 |
| E | | 0.39 | 0.42 | | 1.16 | 3.22 |
| F | | 0.22 | 0.24 | | 0.93 | 1.03 |

EXAMPLE 2

In addition to the cores described above, ten larger toroidal cores were also constructed from some of the preferred alloys of the invention, annealed, and tested. These cores had about 12 kg of core material. The ribbons chosen for these cores were 4.2" wide, and were derived from different large scale casts of two nominal alloy compositions: $Fe_{79.5}B_{9.25}Si_{7.5}C_{3.75}$ and $Fe_{79}B_{8.5}Si_{8.5}C_4$. The cores had an internal diameter of about 7" and an external diameter of about 9", and were annealed in an inert atmosphere nominally at 370° C. for 2 hours. Due to the size of the cores, not all of the core material may have been exposed to the anneal temperature for the same time. The resultant average core losses from these cores was 0.25 W/kg with a standard deviation of 0.023 W/kg, and the average exciting power was 0.40 VA/kg with a standard deviation of 0.12 VA/kg, when measured under 60 Hz and 1.4 T at 25° C., for both the compositions studied. These values are comparable to those found in the smaller diameter cores for similar compositions.

It is well understood in the art that, because of strains on the core material associated with winding of toroidal cores, the core losses measured on such cores are generally higher than those obtained if the material were to be annealed and characterized for core losses as an unstrained straight strip. In the case of ribbons wider than about 1 ", for example, for a given core bobbin diameter, this effect is more pronounced in the case of 30 to 70 g cores containing multiple windings of strips of core materials, than in the case of cores containing only a single layer or, at most, 2–3 layers of such ribbons. The measured core loss in a 30–70 g core often can be substantially greater than that measured on a straight strip.

This is one manifestation of what is referred to as the "destruction factor" in the transformer core manufacturing industry. The so called destruction factor (sometimes referred to as the "build factor") is usually defined as the ratio of the actual core loss obtained from the core material in a fully assembled transformer core and the core loss obtained from straight strips of the same material in a quality control laboratory. It is believed that the above referred effect of strains associated with winding the core material is not as great in the case of a "real life" transformer core, since the diameters are much larger in these cores, than in the laboratory cores described previously. The "destruction" in these cores is more a consequence of the core assembly procedure itself. As an example, in one scheme for transformer construction, the annealed core has to be opened up to allow coils to be inserted around the core. Apart from the destruction associated with cutting, etc. of the core material, newly introduced stresses contribute to an increase in the core loss. Depending on the core construction scheme, a core loss value in the range of 0.2–0.3 W/kg in a small diameter toroidal core, as in the case of the exemplary cores of alloys of this invention, could conceivably increase to fall in the range of about 0.3–0.4 W/kg in a "real" transformer core.

EXAMPLE 3

Wound test cores 11–16 of the metallic glass alloy of the invention (nominal composition $Fe_{79.7}B_{9.1}Si_{7.2}C_{4.0}$) were fabricated and annealed in an inert atmosphere using conventional methods. Each core comprised about 100 kg of ribbon 6.7" wide wound generally toroidally. These cores were of the approximate size appointed for use in commercial distribution transformers of 20–30 kVA rating. The cores (listed in Table IV) were annealed in the presence of a magnetic field applied along the toroidal direction. Temperatures were measured by thermocouples. The center of each core was held at a center temperature for the anneal time listed, then the cores were cooled to ambient in about 6 hours. The core losses and exciting powers under sinusoidal flux excitation at 60 Hz were determined using standard methods including an average responding voltmeter to measure flux, RMS-responding meters to measure current, voltage, and exciting power, and an electronic wattmeter to measure power loss. Core loss and exciting power data for these cores measured at room temperature at maximum inductions of 1.3 T and 1.4 T are depicted in Table IV below.

TABLE IV

| Core Number | Annealing Field (Oe) | Center Temperature (°C.) | 1.4 T Loss (W/kg) | 1.4 T VA (VA/kg) | 1.3 T Loss (W/kg) | 1.3 T VA (VA/kg) |
|---|---|---|---|---|---|---|
| 11 | 6 | 340 | 0.282 | 0.824 | 0.23 | 0.465 |
| 12 | 6 | 325 | 0.301 | 2.13 | 0.251 | 0.984 |
| 13 | 6 | 340 | 0.284 | 0.971 | 0.218 | 0.379 |
| 14 | 12 | 340 | 0.267 | 0.873 | 0.222 | 0.522 |
| 15 | 12 | 337 | 0.256 | 1.12 | 0.212 | 0.572 |
| 15 | 12 | 330 | 0.266 | 1.79 | — | — |

Wound test scores 11, 13 and 14 evidenced a core loss not greater than about 0.3 W/kg and an exciting power value not greater than about 1.0 VA/kg, when measured at 25° C., 60 Hz, and 1.4 T, which values are preferred for use in commercial distribution transformers.

EXAMPLE 4

Samples of the metallic alloy of the invention were prepared as ribbons by planar flow casting as described hereinabove. The samples were 23 μm average thickness and 6.7" wide. The compositions of samples 20–27 are listed in Table V(a) below. Four batches of samples were prepared. Each batch of samples comprised four 30-cm long ribbons of each of samples 20–27. Each of the batches was subjected to a heat treatment. The samples of each batch in turn were placed in a magnetic yoke which served as a flux closure and means for applying a magnetic field along the casting direction of the ribbons. The batch was then heat treated at a temperature and held for a time as described in Tables V(b)–V(e) below. A field of at least 10 oersteds was maintained during the heat treatment and the cool-down.

The core losses and exciting powers under sinusoidal flux excitation of the samples in the flat-strip configuration were then characterized using standard methods. A digital oscilloscope sensed average voltage to determine flux and also RMS current and voltage to obtain exciting power. Core loss was calculated as the average of the instantaneous power determined by multiplying the digitized current and voltage waveforms. Core losses and exciting powers measured at room temperature, 60 Hz, and 1.4 T for the most preferred alloys were not greater than about 0.15 W/kg and 0.5VA/kg, respectively.

TABLE V(a)

Metallic alloy samples of the invention. Samples were prepared as ribbons 6.7" wide in commercial quantities. Compositions are listed in atom percent of Fe, B, Si, and C, as determined by chemical analysis of the ribbons, and neglecting incidental impurities.

| Sample Number | Composition (at.%) Fe | B | Si | C |
|---|---|---|---|---|
| 20 | 80.2 | 9.2 | 7.0 | 3.6 |
| 21 | 80.2 | 9.2 | 7.0 | 3.6 |
| 22 | 80.2 | 9.2 | 7.0 | 3.6 |
| 23 | 80.2 | 9.2 | 7.0 | 3.6 |
| 24 | 80.1 | 9.2 | 7.0 | 3.7 |
| 25 | 80.1 | 9.1 | 7.0 | 3.8 |
| 26 | 80.2 | 9.1 | 7.0 | 3.7 |
| 27 | 80.2 | 9.1 | 7.0 | 3.7 |

TABLE V(b)

Core losses and exciting powers of straight-strip samples of the alloy of the invention. Samples were annealed at 352° C. for 50 min., then cooled to ambient and measured with 60 Hz sinusoidal flux excitation to maximum levels of 1.3 and 1.4 T. Core losses are in W/kg and exciting powers are in VA/kg.

| | 1.3 T | | 1.4 T | |
|---|---|---|---|---|
| Sample Number | Core Loss | Exciting Power | Core Loss | Exciting Power |
| 20 | 0.118 | 0.222 | 0.144 | 0.533 |
| 21 | 0.123 | 0.355 | 0.145 | 0.583 |
| 22 | 0.121 | 0.351 | 0.150 | 0.061 |
| 23 | 0.121 | 0.339 | 0.137 | 0.544 |
| 24 | 0.115 | 0.278 | 0.139 | 0.430 |
| 25 | 0.123 | 0.318 | 0.142 | 0.502 |
| 26 | 0.126 | 0.306 | 0.143 | 0.439 |
| 27 | 0.115 | 0.284 | 0.159 | 0.617 |

TABLE V(c)

Core losses and exciting powers of straight-strip samples of the alloy of the invention. Samples were annealed at 355° C. for 90 min. then cooled to ambient and with 60 Hz sinusoidal flux excitation to maximum levels of 1.3 and 1.4 T. Core losses are in W/kg and exciting powers are in VA/kg.

| | 1.3 T | | 1.4 T | |
|---|---|---|---|---|
| Sample Number | Core Loss | Exciting Power | Core Loss | Exciting Power |
| 20 | 0.142 | 0.302 | 0.163 | 0.418 |
| 21 | 0.141 | 0.299 | 0.158 | 0.388 |
| 22 | 0.141 | 0.308 | 0.165 | 0.471 |
| 23 | 0.150 | 0.329 | 0.159 | 0.381 |
| 24 | 0.131 | 0.256 | 0.154 | 0.334 |
| 25 | 0.131 | 0.289 | 0.149 | 0.394 |
| 26 | 0.134 | 0.266 | 0.160 | 0.371 |
| 27 | 0.131 | 0.282 | 0.157 | 0.406 |

TABLE V(d)

Core losses and exciting powers of straight-strip samples of the alloy of the invention. Samples were annealed at 348° C. for 90 min., then cooled to ambient and measured with 60 Hz sinusoidal flux excitation to maximum levels of 1.3 and 1.4 T. Core losses are in W/kg and exciting powers are in VA/kg.

| | 1.3 T | | 1.4 T | |
|---|---|---|---|---|
| Sample Number | Core Loss | Exciting Power | Core Loss | Exciting Power |
| 20 | 0.124 | 0.278 | 0.144 | 0.406 |
| 21 | 0.120 | 0.259 | 0.147 | 0.403 |
| 22 | 0.127 | 0.336 | 0.150 | 0.631 |
| 23 | 0.129 | 0.292 | 0.152 | 0.433 |
| 24 | 0.123 | 0.262 | 0.147 | 0.186 |
| 25 | 0.127 | 0.297 | 0.152 | 0.475 |
| 26 | 0.129 | 0.306 | 0.155 | 0.507 |
| 27 | 0.137 | 0.336 | 0.168 | 0.610 |

TABLE V(e)

Core losses and exciting powers of straight-strip samples of the alloy of the invention. Samples were heated briefly to 356° C., then cooled to 350° C., held for 45 min., and then cooled to ambient. They were measured with 60 Hz sinusoidal flux excitation to maximum levels of 1.3 T and 1.4 T. Core losses are in W/kg and exciting powers are in VA/kg.

| | 1.3 T | | 1.4 T | |
|---|---|---|---|---|
| Sample Number | Core Loss | Exciting Power | Core Loss | Exciting Power |
| 20 | 0.117 | 0.320 | 0.140 | 0.513 |
| 21 | 0.129 | 0.350 | 0.157 | 0.630 |
| 22 | 0.130 | 0.447 | 0.157 | 0.841 |
| 23 | 0.127 | 0.333 | 0.149 | 0.521 |
| 24 | 0.123 | 0.304 | 0.144 | 0.179 |
| 25 | 0.131 | 0.381 | 0.159 | 0.673 |
| 26 | 0.130 | 0.353 | 0.156 | 0.652 |
| 27 | 0.131 | 0.369 | 0.163 | 0.717 |

EXAMPLE 5

Toroidal test cores 31–34 of the metallic glass alloy of the invention (nominal composition $Fe_{80.3}B_{9.1}$ $Si_{6.9}C_{3.7}$) and comparison cores 35–37 of a commercial Fe-B-Si metallic glass alloy (METGLAS TCA) outside the scope of the invention were fabricated and annealed in an inert atmosphere using conventional methods. Each of cores 31–33 and 35–36 comprised about 80 kg of ribbon 5.6" wide wound toroidally. Each of cores 34 and 37 comprised about 100kg of ribbon 6.7" wide, wound toroidally. The cores were annealed in the presence of a magnetic field of at least 6 oersteds applied along the toroidal direction. The cores were heated to the center temperature indicated, held for two hours, and then cooled to ambient in about 6 hours. Their core losses and exciting powers under sinusoidal flux excitation were tested using standard methods including an average responding voltmeter to measure flux, RMS-responding meters to measure current, voltage, and exciting power, and an electronic wattmeter to measure power loss. Core loss and exciting power data for some of these cores, measured at room temperature and at a 1.3 T maximum induction are depicted in Table VI below for a series of frequencies.

TABLE VI

| Core Number | 31 | 32 | 33 | 35 | 36 |
|---|---|---|---|---|---|
| Anneal Temperature (°C.) | 335 | 340 | 340 | 340 | 340 |
| Anneal Time (h) | 1 | 3 | 4 | 0.5 | 0.5 |
| Frequency (Hz) | Core Loss (W/kg) | | | | |
| 10 | 0.025 | 0.024 | 0.024 | 0.023 | 0.022 |
| 20 | 0.056 | 0.052 | 0.054 | 0.054 | 0.053 |
| 30 | 0.089 | 0.084 | 0.087 | 0.091 | 0.089 |
| 40 | 0.125 | 0.117 | 0.122 | 0.131 | 0.129 |
| 50 | 0.165 | 0.154 | 0.161 | 0.175 | 0.173 |
| 60 | 0.205 | 0.193 | 0.203 | 0.223 | 0.264 |
| Frequency (Hz) | Exciting Power (VA/kg) | | | | |
| 10 | 0.232 | 0.128 | 0.078 | 0.056 | 0.095 |
| 20 | 0.478 | 0.262 | 0.160 | 0.121 | 0.197 |
| 30 | 0.720 | 0.399 | 0.245 | 0.190 | 0.304 |

TABLE VI-continued

| | | | | | |
|---|---|---|---|---|---|
| 40 | 0.969 | 0.536 | 0.331 | 0.276 | 0.429 |
| 50 | 1.22 | 0.676 | 0.423 | 0.337 | 0.527 |
| 60 | 1.46 | 0.813 | 0.517 | 0.420 | 1.54 |

Figure 5:
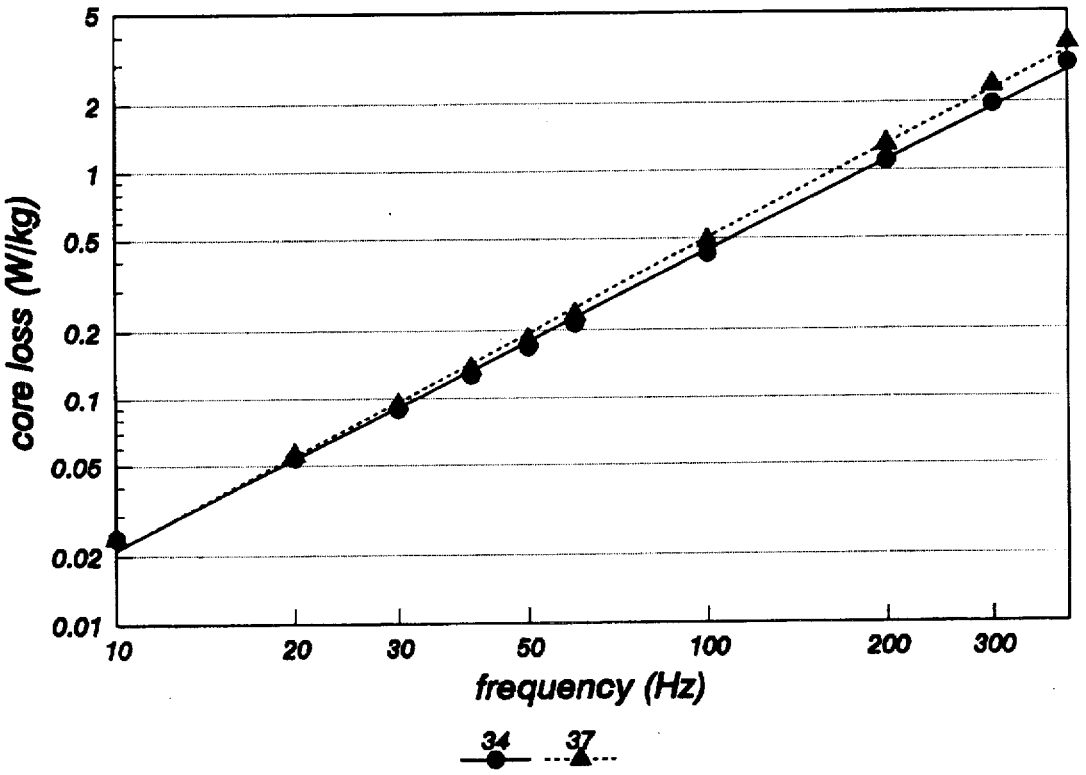
FIG. 5 is a plot of the core loss versus excitation frequency for test cores of the invention and of the prior art, the straight lines being regression fits to the data.

Data are plotted in FIG. 5 as core loss versus frequency for cores 34 and 37. As illustrated by FIG. 5, the slope of the regression line for prior art alloy core 37 is higher than for core 34, indicative that losses for the former increase substantially faster with increasing frequency. Further, as illustrated by FIG. 5, the core loss of core 34 at 400 Hz, 1.3 T, and room temperature is less than about 3 W/kg, while the core loss of core 37 at the same conditions is above 3.6 W/kg, making such cores especially advantageous for use in airborne electrical equipment operating at 400 Hz and in other electronic applications in the kilohertz range.

Having thus described the invention in rather full detail, it will be understood that this detail need not be strictly adhered to but that further changes and modifications may suggest themselves to one skilled in the art, all falling within the scope of the invention as defined by the subjoined claims.

What is claimed is:

1. A metallic alloy composed of iron, boron, silicon, and carbon, which is at least about 70% amorphous, and which consists essentially of the composition $Fe_aB_bSi_cC_d$, where "a"–"d" are in atomic percent, the sum of "a", "b", "c", and "d" equals 100, "a" ranges from about 79 to about 80.5, "b" ranges from about 8.5 to about 10.25, "c" ranges from about 5.25 to about 8.5, and "d" ranges from about 3.25 to about 4.5, with the provisos that:

(i) for "c">7.5, "d" is at least about 4; and (ii) for "a">80, "b" is at least about 8.75;

said alloy having up to 0.5 atom percent of impurities therein, and having a crystallization temperature of at least about 500° C.

2. The metallic alloy of claim 1 which is essentially 100% amorphous.

3. The metallic alloy of claim 1 wherein the impurity content is no greater than 0.3 atomic percent.

4. The metallic alloy of claim 3 which is essentially 100% amorphous.

5. The metallic alloy of claim 1, having the composition $Fe_{79.5}B_{9.25}Si_{7.5}C_{3.75}$, $Fe_{79}B_{8.5}Si_{8.5}C_4$, or $Fe_{79.1}B_{8.9}Si_8C_4$.

6. The metallic alloy of claim 4, having the composition $Fe_{79.5}B_{9.25}Si_{7.5}C_{3.75}$, $Fe_{79}B_{8.5}Si_{8.5}C_4$, $Fe_{79.1}B_{8.9}Si_8C_4$, $Fe_{80.2}B_{9.2}Si_{7.0}C_{3.6}$, $Fe_{78.5}B_{11.5}Si_{7.5}C_{2.5}$, $Fe_{80.1}B_{9.2}Si_{7.0}C_{3.7}$, or $Fe_{80.2}B_{9.1}$ $Si_{7.0}C_{3.7}$.

7. The metallic alloy of claim 1, wherein the Curie temperature is at least 360° C., and the saturation magnetization corresponds to a magnetic moment of at least about 165 emu/g.

8. The metallic alloy of claim 1, in which a core loss not greater than about 0.35 W/kg and an exciting power value not greater than about 1 VA/kg are obtained, when measured at 25° C., 60 Hz and 1.4 T, after the alloy has been annealed.

9. The metallic alloy of claim 1, in which a core loss not greater than about 0.28 W/kg and an exciting power value not greater than about 1 VA/kg are obtained, when measured at 25° C., 60 Hz and 1.4 T, after the alloy has been annealed.

10. The metallic alloy of claim 1, in which a core loss not greater than about 0.2 W/kg and an exciting power value not greater than about 0.6 VA/kg are obtained, when measured at 25° C., 60 Hz and 1.4 T, after the alloy has been annealed.

11. A magnetic core comprising metallic strip formed of the alloy of claim 1, wherein the alloy is at least about 90% amorphous.

12. The magnetic core of claim 11, in which a core loss not greater than about 0.35 W/kg and an exciting power value not greater than about 1 VA/kg are obtained, when measured at 25° C., 60 Hz and 1.4 T.

13. An article of manufacture comprising an alloy of claim 1.

14. The magnetic core of claim 11, in which a core loss not greater than about 3 W/kg is obtained, when measured at 25° C., 400 Hz and 1.3 T.

15. A gapped magnetic core comprising metallic strip formed of the alloy of claim 1, wherein the alloy is at least about 90% amorphous.

16. The metallic alloy of claim 1, having a composition wherein "c" is at least about 6.5%.

17. The magnetic alloy of claim 10, in which a core loss not greater than about 0.15 W/kg and an exciting power value not greater than about 0.5 VA/kg are obtained, when measured at 25° C., 60 Hz, and 1.4 T, after the alloy has been annealed.

18. The magnetic core of claim 12, in which a core loss not greater than about 0.3 W/kg and an exciting power value not greater than about 1.0 VA/kg are obtained, when measured at 25° C., 60 Hz, and 1.4 T.

19. The metallic alloy of claim 16, having the composition $Fe_{79.5}B_{9.25}Si_{7.5}C_{3.75}$, $Fe_{79}B_{8.5}Si_{8.5}C_4$, $Fe_{79.1}B_{8.9}Si_8C_4$, $Fe_{80.2}B_{9.2}Si_{7.0}C_{3.6}$, $Fe_{78.5}B_{11.5}Si_{7.5}C_{2.5}$, $Fe_{80.1}B_{9.2}Si_{7.0}C_{3.7}$, or $Fe_{80.2}B_{9.1}$ $Si_{7.0}C_{3.7}$.

* * * * *